US010128609B2

(12) United States Patent
Hodge et al.

(10) Patent No.: US 10,128,609 B2
(45) Date of Patent: Nov. 13, 2018

(54) WATER RESISTANT CONNECTOR ASSEMBLY

(71) Applicant: Molex, LLC, Lisle, IL (US)

(72) Inventors: Ronald C. Hodge, Aurora, IL (US); Ishwarappa Ganamukhi, Bangalore (IN); Dennis W. Berek, Naperville, IL (US); Michael Bean, Elburn, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/507,875

(22) PCT Filed: Oct. 2, 2015

(86) PCT No.: PCT/US2015/053726
§ 371 (c)(1),
(2) Date: Mar. 1, 2017

(87) PCT Pub. No.: WO2016/057329
PCT Pub. Date: Apr. 14, 2016

(65) Prior Publication Data

US 2017/0250498 A1 Aug. 31, 2017

Related U.S. Application Data

(60) Provisional application No. 62/060,382, filed on Oct. 6, 2014.

(51) Int. Cl.
*H01R 13/52* (2006.01)
*H01R 13/639* (2006.01)

(52) U.S. Cl.
CPC ..... *H01R 13/5221* (2013.01); *H01R 13/5208* (2013.01); *H01R 13/639* (2013.01)

(58) Field of Classification Search
CPC ..... H01R 13/5219; H01R 13/5221; H01R 13/5208
See application file for complete search history.

(56) References Cited

U.S. PATENT DOCUMENTS 4,214,802 A * 7/1980 Otani ..... H01R 13/5221 439/275
4,639,061 A 1/1987 Muzslay
4,895,529 A 1/1990 Thakrar et al.
(Continued)

FOREIGN PATENT DOCUMENTS

CN 204304090 U 4/2015
JP 2002-198116 A 7/2002
(Continued)

*Primary Examiner* — Neil Abrams
(74) *Attorney, Agent, or Firm* — James A. O'Malley

(57) ABSTRACT

A water resistant connector assembly includes first and second connectors. Each connector has a housing and a water resistant seal. Each connector is formed in a two-shot operation with the housing being formed of polypropylene and the seal being formed of a thermoplastic elastomer. The seal of one of the connectors has a portion that is provided on an outer surface thereof and has ribs which fold over in a direction opposite a water ingression direction when the second connector is connected to the first convector, thereby creating a seal between the connectors when they are connected. The seals of each of the connectors are also provided at terminal/wire insertion areas, and these seals ensure proper insertion of the terminal/wires. These seals may further include strain relief portions to provide resistance to angularity of the wire.

33 Claims, 18 Drawing Sheets

(56) References Cited

U.S. PATENT DOCUMENTS

| | | | | |
|---|---|---|---|---|
| 4,936,791 | A * | 6/1990 | Zielinski | H01R 13/5219 439/271 |
| 5,922,263 | A * | 7/1999 | Endo | H01R 13/5202 264/255 |
| 5,993,233 | A * | 11/1999 | Fukuda | H01R 43/005 439/271 |
| 6,341,983 | B1 * | 1/2002 | Crawford | H01R 13/521 439/275 |
| 6,371,807 | B1 * | 4/2002 | Takagishi | H01R 13/5221 439/587 |
| 6,521,160 | B2 * | 2/2003 | Suzuki | H01R 13/5205 264/267 |
| 7,488,196 | B2 * | 2/2009 | Kocher | H01R 4/26 439/393 |
| 7,922,530 | B2 | 4/2011 | Chazottes et al. | |
| 8,105,099 | B2 | 1/2012 | Suzuki et al. | |
| 8,574,000 | B1 * | 11/2013 | Smith | H01R 13/562 439/447 |
| 8,647,150 | B2 * | 2/2014 | Fujiwara | H01R 13/5221 439/587 |
| 8,662,910 | B2 | 3/2014 | Ichio et al. | |
| 8,771,014 | B2 * | 7/2014 | Nakamura | H01R 13/5208 439/587 |
| 9,106,000 | B2 | 8/2015 | Mizutani et al. | |
| 9,425,541 | B2 | 8/2016 | Data et al. | |
| 2014/0011400 | A1 | 1/2014 | Shiga | |
| 2014/0011401 | A1 | 1/2014 | Endo et al. | |
| 2014/0051276 | A1 | 2/2014 | Itou | |
| 2017/0250498 | A1 * | 8/2017 | Hodge | H01R 13/5208 |

FOREIGN PATENT DOCUMENTS

| | | | |
|---|---|---|---|
| JP | 2007-005155 | A | 1/2007 |
| JP | 2013-008454 | A | 1/2013 |
| JP | 2013-077407 | A | 4/2013 |
| TW | M432982 | Y | 7/2012 |
| TW | M475730 | Y | 4/2014 |

* cited by examiner

WATER RESISTANT CONNECTOR ASSEMBLY

CROSS-REFERENCE TO RELATED APPLICATIONS

This patent application claims the benefit of U.S. Provisional Patent Application No. 62/060,382, filed Oct. 6, 2014, which is incorporated herein by reference in its entirety.

TECHNICAL FIELD

This disclosure relates to the field of connectors, more specifically to connectors intended to offer some level of resistance to water ingression.

BACKGROUND

Connectors resistant to water ingression are known. A connector will typically include a housing that supports one or more terminals. The housing is often formed from a resin that provides suitable strength and rigidity. Unfortunately, due to variations that occur during the manufacture process, it is difficult to have a water resistant seal formed between two housings, as there will generally be gaps sufficiently large to allow water to enter into the housing. Therefore, one connector will often include a gasket or seal at the mating interface that engages a second mating connector and the seal creates a barrier to water ingression.

While the above process is known, existing designs tend to be limited in how the housing and seal can be formed. The seal will typically be of a lower durometer than the housings such that it can be compressed between the housings when the two housings are mated together. The mating operation can translate softer materials, but it generally is undesirable for the seal to move. Many designs, therefore, include a captured seal (e.g., a seal that is placed in a recess or secured by a lip of the housing such that it does not move during the mating process). While effective for sealing purposes, the use of lips and/or recesses to provide a captured seal configuration tend to place limits on the design of the connector.

Another issue is encountered when providing a wire-to-wire connector system. In such a system, there is need for a seal between mating connectors and between the housing and corresponding cable/wire that is connected to the housing. This is often complicated by the fact that the wire needs to be connected to a terminal. One way to seal the housing to the wire is to insert mold the housing around the wire. A problem with such a design, however, is that directly molding the housing to the wire substantially limits the ability to provide a connector that can be used in a variety of situations (because each application tends to need a different length of wire). Therefore, it is desirable to provide a seal that can create a seal around the wire.

Consequentially, existing designs tend to have shortcomings that make their designs sub-optimal for certain applications. Accordingly, certain individuals would appreciate further improvements in a connector that is resistant to water ingression and can still provide desirable flexibility.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY OF THE INVENTION

In a first aspect of an embodiment of the invention, a water resistant connector is provided. The water resistant connector has a housing which extends from a forward surface to a rearward surface. The housing defines a seal accommodation chamber which is open to the rearward surface of the housing. The housing further defines at least one terminal accommodation chamber which is in communication with the seal accommodation chamber and which extends forward toward the for surface of the housing. The water resistant connector also has a first water resistant seal positioned in the seal accommodation chamber and chemically bonded to the housing. The first water resistant seal has a rearward surface which is generally flush with the rearward surface of the housing. The first water resistant seal has at least one through hole provided therethrough. The at least one through hole is in alignment with the at least one terminal accommodation chamber of the housing. The first water resistant seal provides at least one rib which extends into the at least one through hole. The at least one rib is configured to seal against a wire inserted therethrough in order to resist an ingress of water to the at least one terminal accommodation chamber via the at least one through hole of the first water resistant seal.

In another embodiment, the housing and the first water resistant seal are formed as a part of a two-shot operation.

In another embodiment, the housing is formed of polypropylene and the first water resistant seal is formed of a thermoplastic elastomer (TPE).

In another embodiment, the at least one terminal accommodation chamber is configured to receive a female terminal therein.

In another embodiment, the at least one terminal accommodation chamber is configured to receive a male terminal therein.

In another embodiment, the first water resistant seal provides a strain relief portion. The strain relief portion is positioned between the rearward surface of the first water resistant seal and the at least one rib which extends into the at least one through hole.

In another embodiment, the strain relief portion comprises a plurality of flanges that extend into the at least one through hole. The plurality of flanges are configured to be positioned against the wire to provide resistance to angularity of the wire.

In another embodiment, each of the flanges are provided equidistantly apart from adjacent flanges.

In another embodiment, each of the flanges has a rearward surface, a first inner surface, a second inner surface, and a third inner surface. The rearward surface of each flange is generally flush with the rearward surface of the first water resistant seal. The first inner surface angularly extends inwardly and forwardly to the second inner surface. The second inner surface extends forwardly to the third inner surface. The third inner surface angularly extends outwardly and forwardly to a wall defined by the at least one through hole.

In another embodiment, a portion of a selectively engageable locking structure is operatively associated with the housing. The selectively engageable locking structure is configured to connect the first water resistant connector to another connector.

In another embodiment, the portion of the selectively engageable locking structure is an resilient latching portion.

In another embodiment, the portion of the selectively engageable locking structure is a lock portion.

In another embodiment, the water resistant connector has a second water resistant Seal. The second water resistant seal is chemically bonded to an outer surface of the housing. The second water resistant seal is configured to create a water resistant seal between the water resistant connector and another connector when the other connector is connected to the water resistant connector.

In another embodiment, the housing, the first water resistant seal, and the second water resistant seal are formed as a part of a two-shot operation.

In another embodiment, the housing is formed of polypropylene and the first and second water resistant seals are formed of a thermoplastic elastomer (TPE).

In another embodiment, the first and second water resistant seals are integrally formed.

In another embodiment, the second water resistant seal has at least one rib extending outwardly therefrom. The at least one rib is configured to fold over in a direction opposite a water ingression direction when the other connector is connected to the water resistant connector. The folding over of the at least one rib against the other connector resists an ingress of water to the at least one terminal accommodation chamber via the connection of the water resistant connector to the other connector.

In another aspect of an embodiment of the invention, a water resistant connector assembly is provided. The water resistant connector assembly has a first connector having a first housing and a first water resistant seal. The first housing has a forward surface and a rearward surface. The first housing has at least one terminal accommodation chamber for housing a first terminal. The first water resistant seal is chemically bonded to an outer surface of the first housing proximate to the forward surface thereof. The first water resistant seal has at least one rib extending outwardly therefrom. The water resistant connector assembly has a second connector having a second housing. The second housing has a forward surface and a rearward surface. The second housing has at least one terminal accommodation chamber for housing a second terminal. The second terminal is configured to be electrically connected to the first terminal. The at least one rib is configured to fold over in a direction opposite a water ingression direction when the second connector is connected to the first connector. The folding over of the at least one rib against the second connector resists an ingress of water to the at least one terminal accommodation chambers of the first and second housings via the connection of the first connector to the second connector.

In another embodiment, the first and second housings each define a seal accommodation chamber which is open to the rearward surfaces of the first and second housings, respectively, and which extends forwardly to the at least one terminal accommodation chambers of the first and second housings, respectively. The seal accommodation chambers are in communication with the at least one terminal accommodation chambers of the first and second housings, respectively. Each of the first and second connectors further include a second water resistant seal positioned in the seal accommodation chambers and chemically bonded to the first and second housings, respectively.

In another embodiment, each second water resistant seal has a rearward surface which is generally flush with the rearward surface of the first and second housing, respectively. Each second water resistant seal has at least one through hole provided therethrough. The at least one through hole being in alignment with the at least one terminal accommodation chambers of the first and second housings, respectively. Each second water resistant seal providing at least one rib which extends into the at least one through hole. The at least one rib is configured to seal against a wire inserted therethrough in order to resist an ingress of water to the at least one terminal accommodation chambers of the first and second housings, respectively, via the at least one through hole of the second water resistant seal.

In another embodiment, each second water resistant seal further provides a strain relief portion. The strain relief portion is positioned between the rearward surface of the second water resistant seal and the at least one rib which extends into the at least one through hole.

In another embodiment, the second water resistant seal of the first connector is integrally formed with the first water resistant seal of the first connector.

In another embodiment, the water resistant connector assembly further includes a selectively engageable locking structure configured to connect the first connector to the second connector. The first water resistant seal is configured to create a water resistant seal between the first connector and the second connector when the selectively engageable locking structure connects the first and second connectors to one another.

In another aspect of an embodiment of the invention, a water resistant connector assembly is provided. The water resistant connector assembly includes a first connector having a first housing and a first water resistant seal. The first housing has a forward surface and a rearward surface. The first housing has at least one terminal accommodation chamber for housing a first terminal. The first water resistant seal is chemically bonded to an outer surface of the first housing proximate to the forward surface thereof. The water resistant connector assembly further includes a second connector having a second housing. The second housing has a forward surface and a rearward surface. The second housing has at least one terminal accommodation chamber for housing a second terminal. The second terminal is configured to be electrically connected to the first terminal. The water resistant connector assembly further includes a selectively engageable locking structure configured to connect the first connector to the second connector. The first water resistant seal is configured to create a water resistant seal between the first connector and the second connector when the selectively engageable locking structure connects the first and second connectors to one another.

BRIEF DESCRIPTION OF THE DRAWINGS

The present invention is illustrated by way of example and not limited in the accompanying figures in which like reference numerals indicate similar elements and in which.

DETAILED DESCRIPTION

Referring to FIGS. 1-4, an embodiment of a water resistant connector assembly is generally designated 20. The water resistant connector assembly 20 includes a first connector 100 and a second connector 200 that are configured to be mated together.

As used herein, the terms forward portion, forward surface or the like are intended to be associated with a mating end of a connector. Likewise, as used herein, the terms rearward portion, rearward surface or the like are intended to be associated with a terminal/wire insertion end of a connector.

Figure 1:
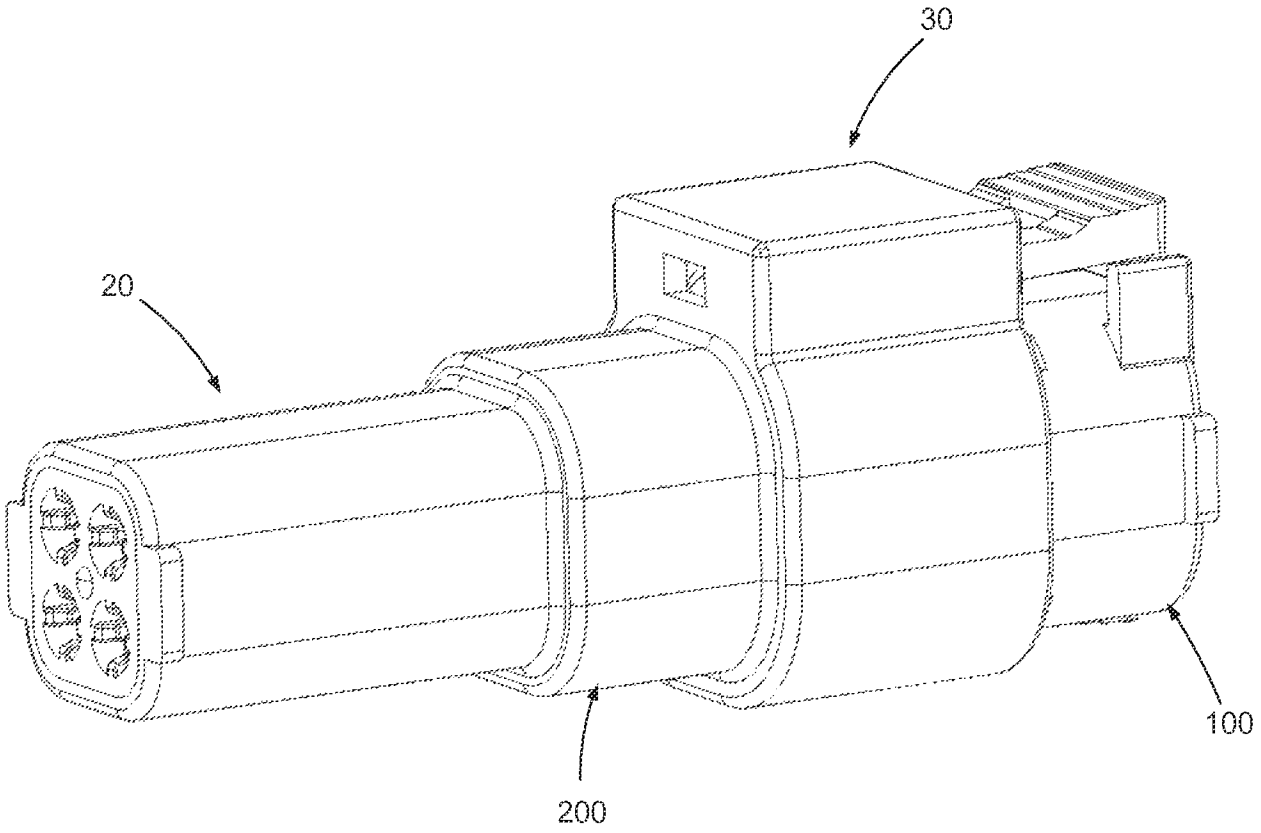
FIG. 1 illustrates a first perspective view of an embodiment of a water resistant connector assembly.
Figure 2:
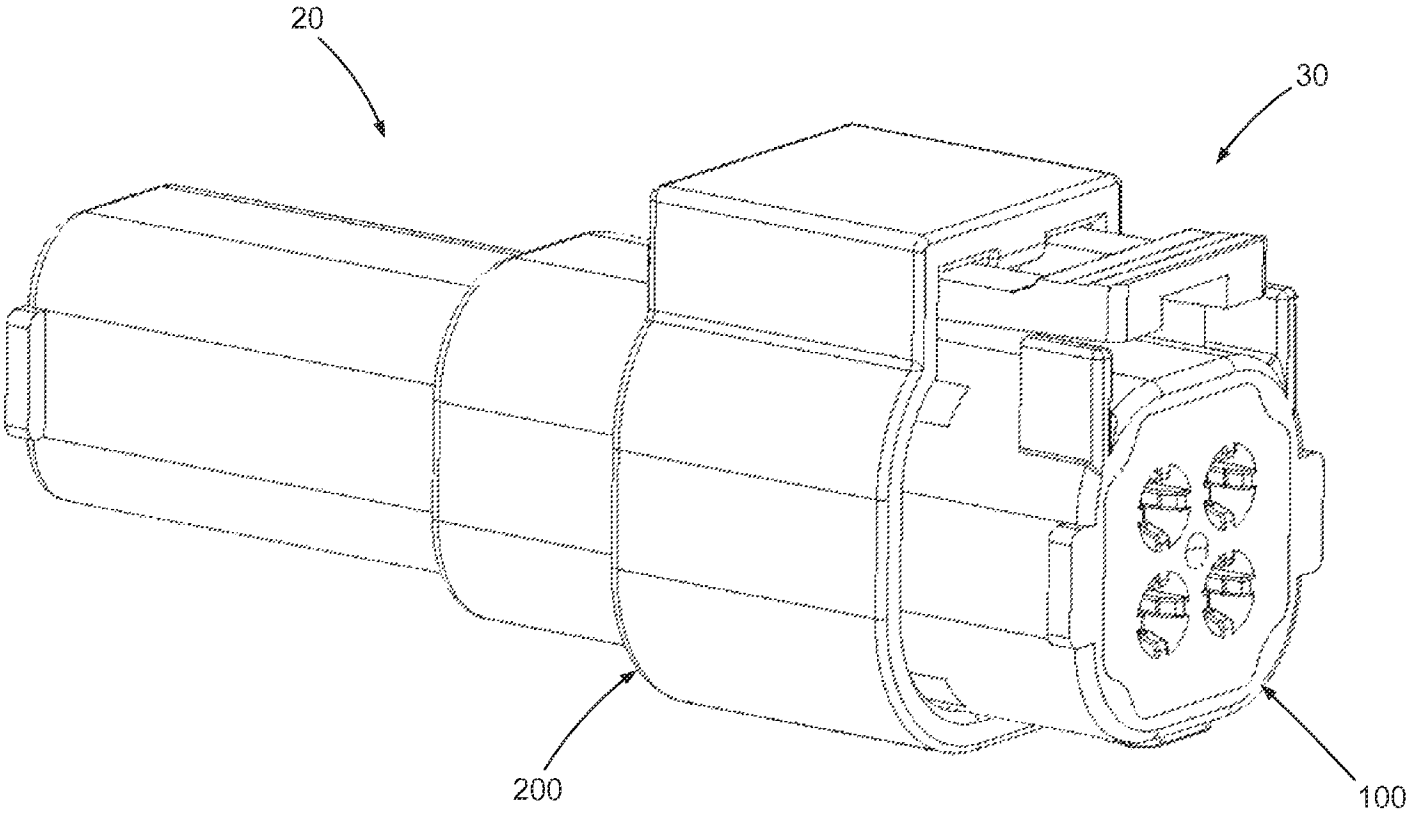
FIG. 2 illustrates a second perspective view of the embodiment of the water resistant connector assembly.
Figure 3:
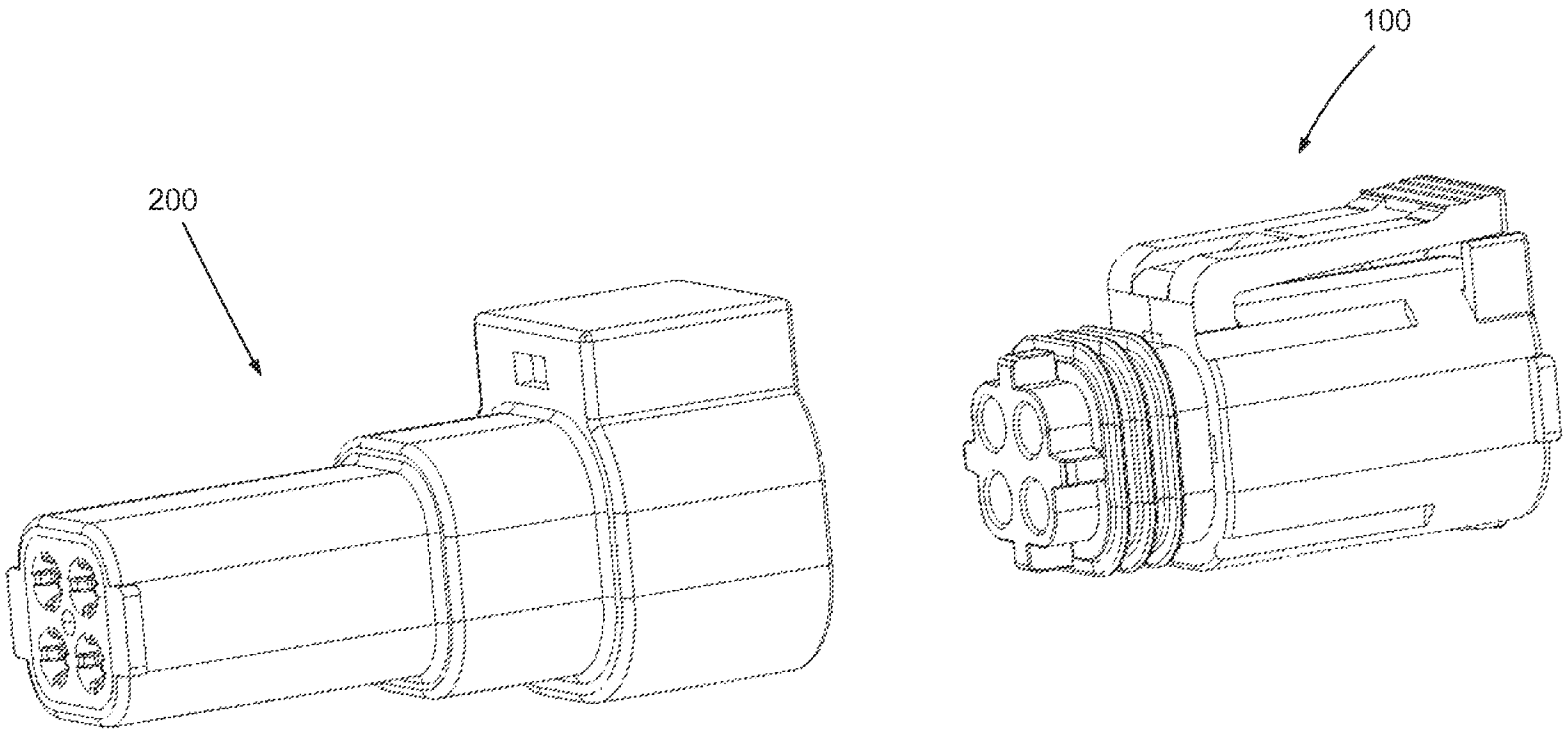
FIG. 3 illustrates a first exploded perspective view of the embodiment of the water resistant connector assembly which illustrates a first connector and a second connector of the water resistant connector assembly.
Figure 4:
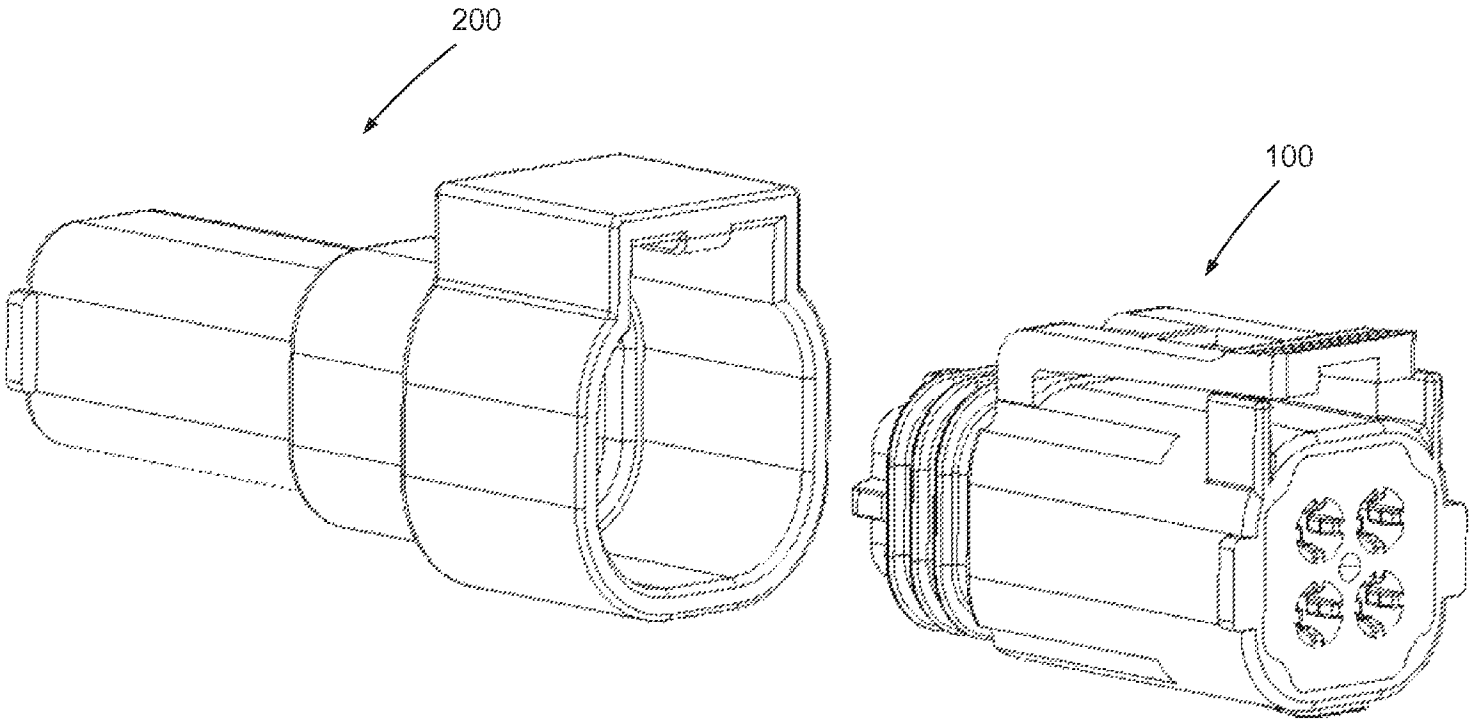
FIG. 4 illustrates a second exploded perspective view of the embodiment of the water resistant connector assembly which illustrates the first connector and the second connector of the water resistant connector assembly.
Figure 5:
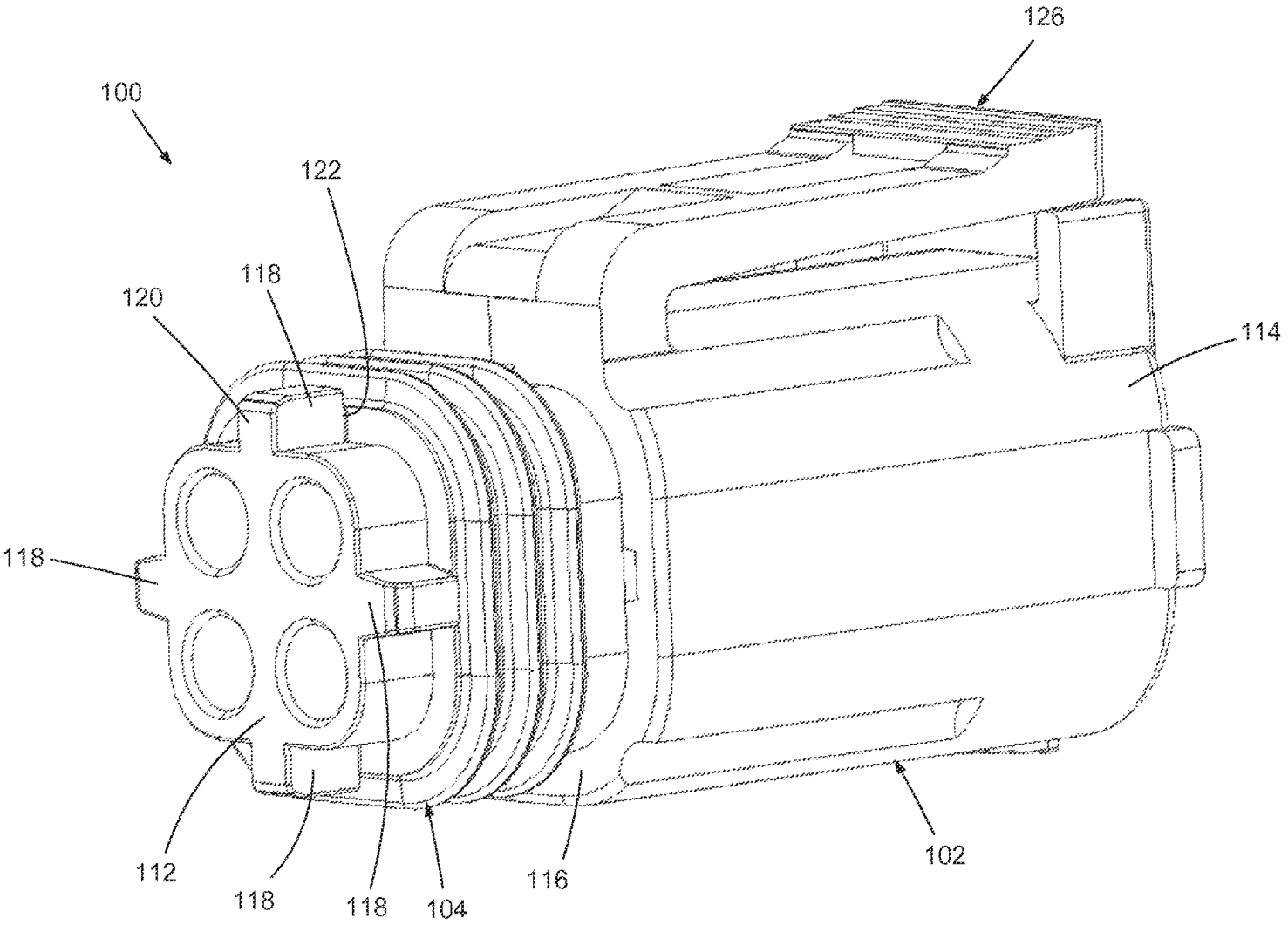
FIG. 5 illustrates a first perspective view of the first connector of the water resistant connector assembly.
Figure 6:
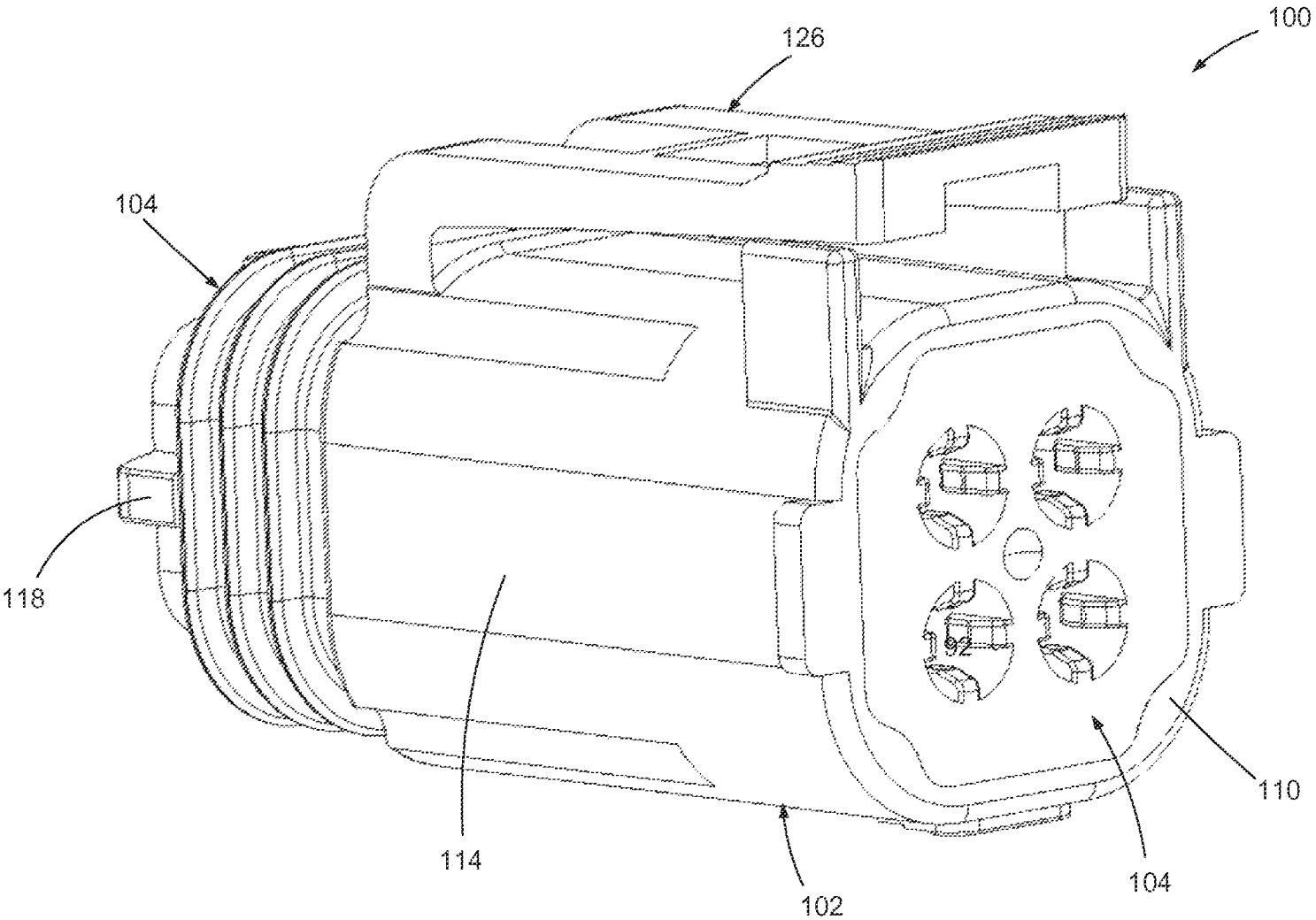
FIG. 6 illustrates a second perspective view of the first connector of the water resistant connector assembly.
Figure 7:
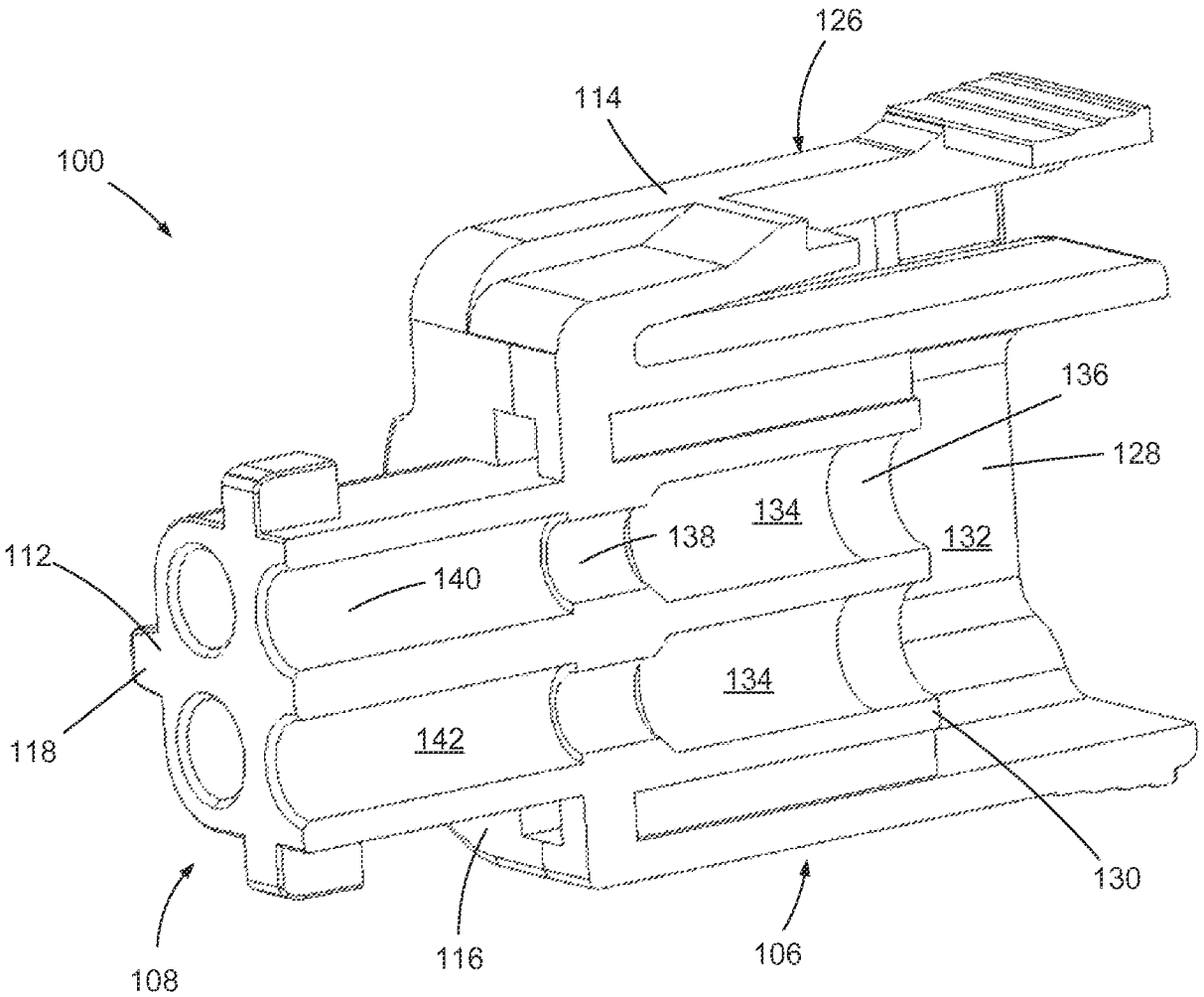
FIG. 7 illustrates a cross-sectional view of a housing of the first connector of the water resistant connector assembly.
Figure 8:
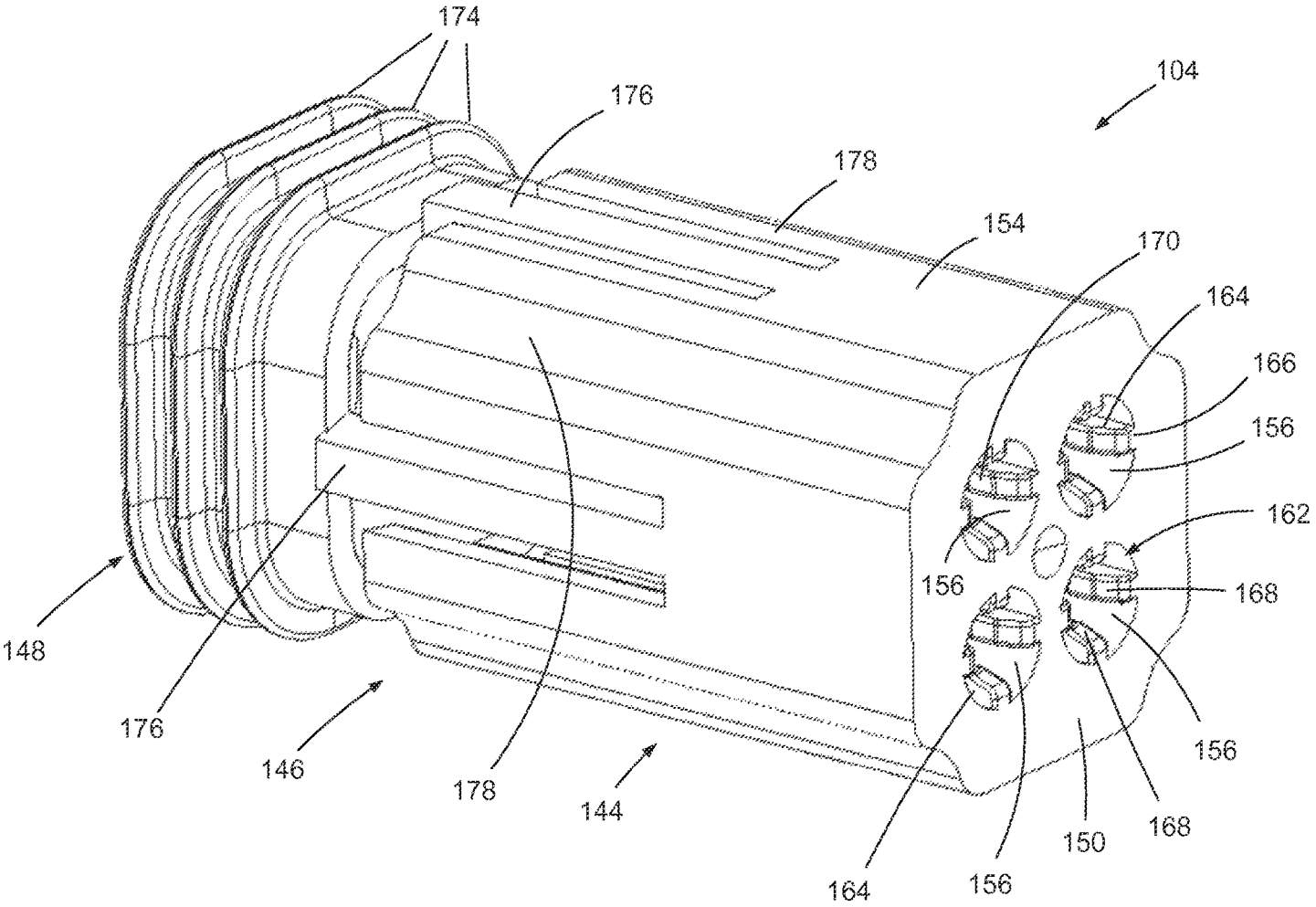
FIG. 8 illustrates a first perspective view of a water resistant seal of the first connector of the water resistant connector assembly.
Figure 9:
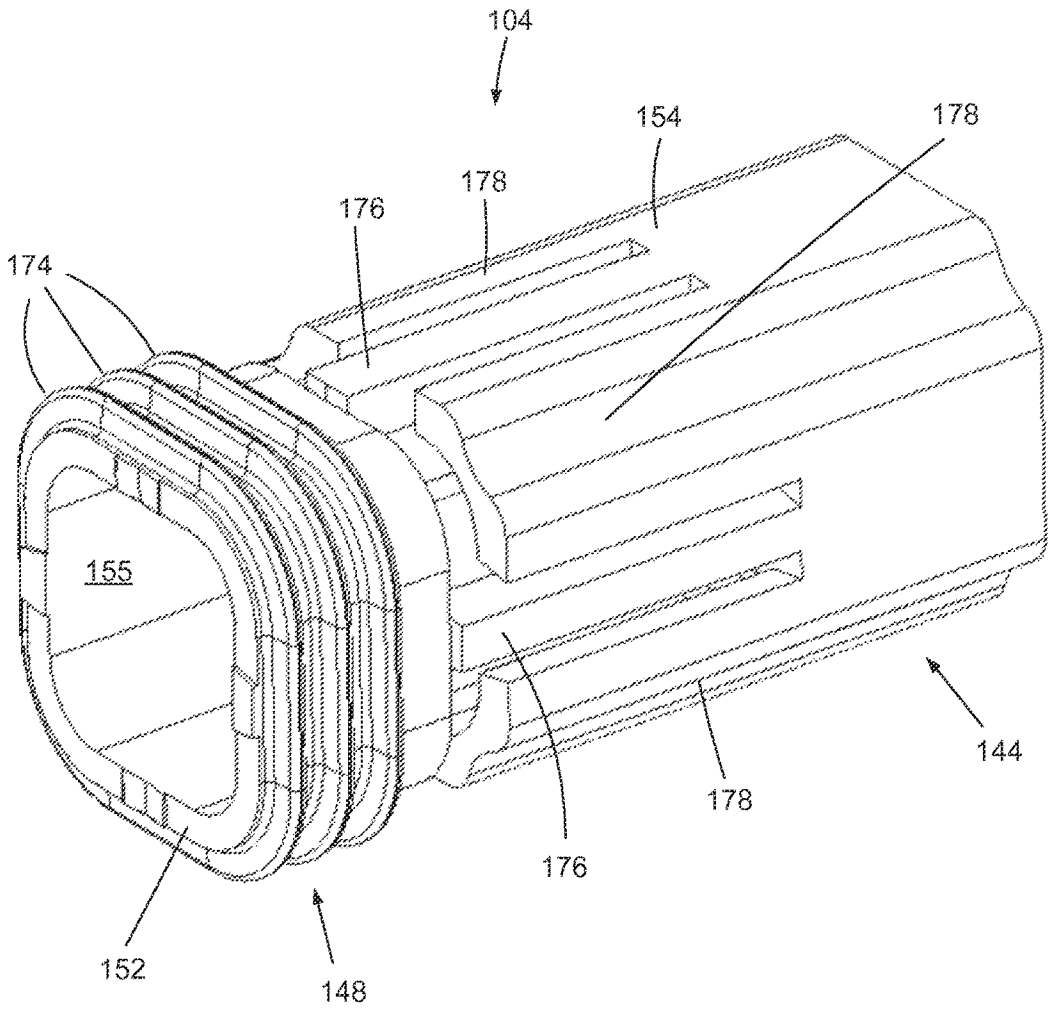
FIG. 9 illustrates a second perspective view of the water resistant seal of the first connector of the water resistant connector assembly.
Figure 10:
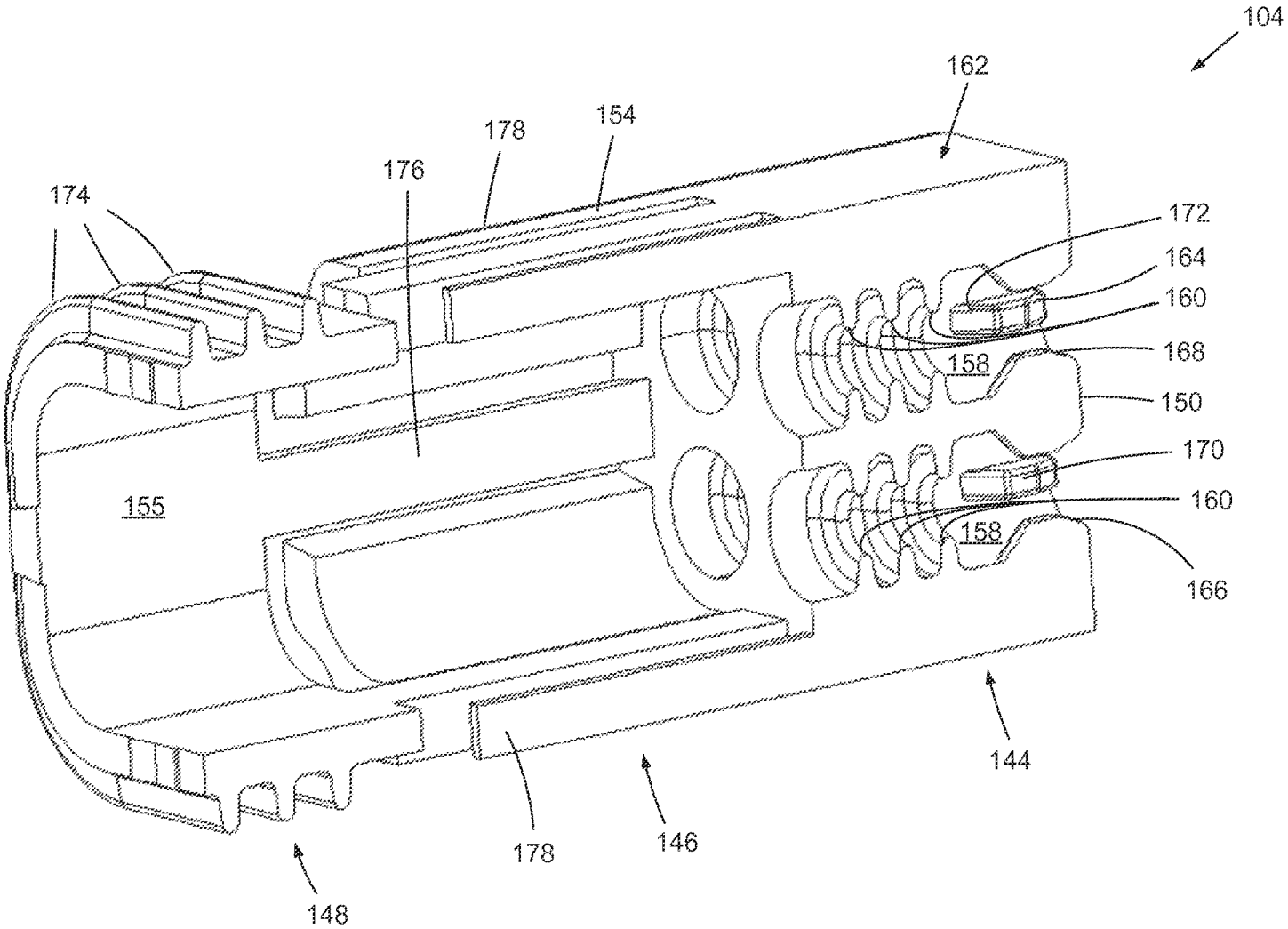
FIG. 10 illustrates a cross-sectional view of the water resistant seal of the first connector of the water resistant connector assembly.

The first connector 100 is best illustrated in FIGS. 5-10. The first connector 100 includes a housing 102 and a water resistant seal 104. The housing 102 is formed in a first molding operation (e.g., a first shot) (as illustrated in FIG. 7) and the water resistant seal 104 is formed in a second molding operation (e.g., a second shot) (FIGS. 8-10 illustrate only the water resistant seal 104). Thus, the first connector 100 is provided with a housing 102 and a water resistant seal 104 formed in a two-shot operation. The water resistant seal 104 is formed of a material that will chemically bond to the housing 102. In a preferred embodiment, the water resistant seal 104 may be formed of a thermoplastic elastomer (TPE) and the housing 102 may be formed of polypropylene.

The housing 102 has a rearward portion 106 and a forward portion 108. The rearward portion 106 extends from a rearward surface 110 of the housing 102 to the forward portion 108. The forward portion 108 extends from the rearward portion 106 to a forward surface 112 of the housing 102. Each of the rearward and forward portions 106, 108 have a substantially box-shape configuration. An outer surface 114 of the housing 102 extends from the rearward surface 110 to the forward surface 112. The rearward portion 106 is larger in configuration relative to the forward portion 108 such that an exposed forward surface of the rearward portion 106 defines an outer shoulder 116 of the outer surface 114 of the housing 102.

The forward portion 108 of the housing 102 has a plurality of flanges 118 that extend outwardly from the outer surface 114. Each flange 118 has a forward surface 120 which is preferably flush with the forward surface 112 of the housing 102. Each flange 118 has a rearward surface 122 which is set apart from the outer shoulder 116, thereby defining recessed portions between the outer shoulder 116 and the flanges 118, respectively. Each flange 118 is preferably provided ninety (90) degrees apart from an adjacent flange 118.

The housing 102 has an resilient latching portion 126 extending outwardly from the rearward portion 106 of the outer surface 114 of the housing 102. The resilient latching portion 126 is preferably provided on the same side of the housing 102 as is one of the flanges 118. In a preferred embodiment, as illustrated in FIGS. 5 and 6, the resilient latching portion 126 does not extend over the forward portion 108 of the housing 102. The resilient latching portion 126 form one part of a selectively engageable locking structure 30 of the water resistant connector assembly 20.

The housing 102 defines a seal accommodation chamber 128. The seal accommodation chamber 128 extends forwardly from the rearward surface 110 of the housing 102 into the rearward portion 106 to an inner rear surface 130 of the housing 102. The seal accommodation chamber 128 defines a chamber wall 132 that extends from the rearward surface 110 of the housing 102 to the inner rear surface 130 of the housing 102. The inner rear surface 130 of the housing 102 is preferably provided in the rearward portion 106 of the housing 102.

The housing 102 defines a plurality of terminal accommodation chambers 134 which extend forwardly from the inner rear surface 130 of the housing 102 to the forward surface 112, of the housing 102. The plurality of terminal accommodation chambers 134, as illustrated in FIGS. 5 and 7, number four (4), but it is to be understood that more of less (even one (1)) could be provided as desired. Furthermore, the plurality of terminal accommodation chambers 134, as illustrated in FIGS. 5 and 7, are provided in a double row in a 2×2 configuration, but it is to be understood that the terminal accommodation chambers 134 could alternatively be provided in a single row. Each of the terminal accommodation chambers 134 has a rearward portion 136, a middle portion 138, and a forward portion 140, each of which are preferably cylindrical in configuration. Each terminal accommodation chamber 134 defines a chamber wall 142 that extends from the inner rear surface 130 of the housing 102 to the forward surface 112 of the housing 102.

The rearward portions 136 of the terminal accommodation chambers 134 extend from the inner rear surface 130 to the corresponding middle portions 138. The middle portions 138 extend from the corresponding rearward portions 136 to the corresponding forward portions 140. The forward portions 140 extend from the corresponding middle portions 138 to the forward surface 112 of the housing 102. The middle portions 138 have diameters which are smaller than diameters of the rearward and forward portions 136, 140 of the housing 102 in order to aid in terminal retention.

As best illustrated in FIGS. 8-10, the water resistant seal 104 (the second shot molded structure that is to be fitted and chemically bonded to the housing 102 to form the first connector 100) has a rearward portion (a mat seal) 144, a middle connecting portion 146, and a forward portion (a ring seal) 148. The rearward portion 144 of the water resistant seal 104 extends from a rearward surface 150 of the water resistant seal 104 to the middle connecting portion 146. The middle connecting portion 146 extends from the rearward portion 144 to the forward portion 148. The forward portion 148 extends from the middle connecting portion 146 to a forward surface 152 of the water resistant seal 104.

The rearward portion 144 of the water resistant seal 104 is configured to be positioned in and fill up the space of the seal accommodation chamber 128 of the housing 102. The rearward surface 150 of the water resistant seal 104 is preferably flush with the rearward surface 110 of the housing 102. An outer surface 154 of the rearward portion 144 of the water resistant seal 104 is chemically bonded to the chamber wall 132 defined by the seal accommodation chamber 128 of the housing 102. The forward surface 152 of the rearward portion 144 of the water resistant seal 104 is chemically bonded to the inner rear surface 130 of the housing 102.

The rearward portion 144 of the water resistant seal 104 defines a plurality of through holes 156, each of which defines a wall 158, which extend forwardly from the rearward surface 150 of the water resistant seal 104 to the forward surface 152 of the rearward portion 144 of the water resistant seal 104. The plurality of through holes 156, as illustrated in FIG. 8, number four (4), but it is to be understood that more of less (even one (1)) could be provided as desired. Furthermore, the plurality of through holes 156, as illustrated in FIG. 8, are provided in a double row in a 2×2 configuration, but it is to be understood that the through holes 156 could alternatively be provided in a single row. The number of through holes 156 provided, and the configuration of the through holes 156 provided, e.g., double row or single row, should match the number and configuration of terminal accommodation chambers 134 provided in the first housing 102. Each one of the through holes 156 is configured to be in alignment with one of the terminal accommodation chambers 134.

Each through hole 156 preferably has a diameter which is preferably equal to a diameter of the rearward portions 136 of the terminal accommodation chambers 134. Thus, the walls 158 of the through holes 156 proximate to the rearward portions 136 of the terminal accommodation chambers 134 are preferably flush with the chamber walls 142 of the rearward portions 136 of the terminal accommodation chambers 134.

The rearward portion 144 of the water resistant seal 104 has a plurality of ribs 160 that circumferentially extend inwardly from each of the walls 158 of the through holes 156. The plurality of ribs 160, as illustrated in FIG. 10, number three (3), but it is to be understood that more or less (even one (1)) could be provided as desired.

Between the plurality of ribs 160 and the rearward surface 150 of the water resistant seal 104, the rearward portion 144 of the water resistant seal 104 has a strain relief portion 162 defined in the through holes 156. The strain relief portion 162 is defined by a plurality of flanges 164 that extend inwardly from the walls 158 of the through holes 156 in a longitudinal direction. Each flange 164 is preferably provided equidistantly apart from an adjacent flange 164. As illustrated, the plurality of flanges 164 preferably number four (4) and are preferably provided ninety (90) degrees apart from an adjacent flange 164. While four (4) flanges 164 are illustrated, it is to be understood that more or less could be provided as desired.

Each flange 164 preferably has a rearward surface 166 that is flush with the rearward surface 150 of the water resistant seal 104. Each flange 164 has a first inner surface 168 that angularly extends inwardly and forwardly to a second inner surface 170. The connection between the rearward surface 166 of the flange 164 and the first inner surface 168 of the flange 164 may be rounded if desired. The second inner surface 170 extends forwardly to a third inner surface 172. The third inner surface 172 extends outwardly and forwardly to the wall 158 of the through hole 156.

The forward portion 148 of the water resistant seal 104 is configured to be positioned around the outer surface 114 of the forward portion 108 of the housing 102, generally between the outer shoulder 116 and the rearward surfaces 122 of the flanges 118. The forward portion 148 of the water resistant seal 104 thus generally fills up the space defined by the recessed portions.

The rearward surface 150 of the forward portion 148 of the water resistant seal 104 is chemically bonded to the outer shoulder 116. The forward surface 152 of the forward portion 148 of the water resistant seal 104 is chemically bonded to the rearward surfaces 122 of the flanges 118. An inner surface 155 of the forward portion 148 of the water resistant seal 104 is chemically bonded to the outer surface 114 of the forward portion 108 of the housing 102.

The outer surface 154 of the forward portion 148 of the water resistant seal 104 has a diameter that is preferably slightly smaller than an outer diameter of the flanges 118. The forward portion 148 of the water resistant seal 104 has a plurality of ribs 174 that circumferentially extend outwardly from the outer surface 154 of the forward portion 148 of the water resistant seal 104. The plurality of ribs 174, as illustrated in FIGS. 8-10, number three (3), but it is to be understood that more or less (even one (1)) could be provided as desired. Each of the ribs 174 has an outer diameter that is larger than an outer diameter of the flanges 118, but which is preferably smaller than an outer diameter of the outer surface 114 of the rearward portion 106 of the housing 102.

The middle connecting portion 146 of the water resistant seal 104 connects the rearward portion 144 of the water resistant seal 104 to the forward portion 148 of the water resistant seal 104. The middle connecting portion 146, as illustrated in FIGS. 8-10, preferably includes four (4) connecting members 176 and four (4) extending members 178, although it is to be understood that more or less could be provided as desired. Each connecting member 176 extends from the forward surface 152 of the rearward portion 144 of the water resistant seal 104 to the rearward surface 150 of the forward portion 148 of the water resistant seal 104. Each extending member 178 extends from the forward surface 152 of the rearward portion 144 of the water resistant seal 104 toward the rearward surface 150 of the forward portion 148 of the water resistant seal 104. Unlike the connecting members 176, the extending members 178 preferably do not extend to, and connect to, the rearward surface 150. Each connecting member 176 and each extending member 178 extends through corresponding holes provided through the rearward portion 106 of the housing 102. The corresponding holes do not interfere with, and are not open to, the terminal accommodation chambers 134 defined by the housing 102.

The corresponding holes are preferably not accessible via the outer surface 114 of the housing 102, but the corresponding holes may alternatively, in whole or in part, be formed as recessed portions provided along the outer surface 114 of the housing 102. The connecting members 176 and the extending members 178 are chemically bonded to the housing 102.

The second connector 200 is best illustrated in FIGS. 11-16. The second connector 200 includes a housing 202 and a water resistant seal 204. The housing 202 is formed in a first molding operation (e.g., a first shot) and the water resistant seal 204 is formed in a second molding operation (e.g., a second shot). Thus, the second connector 200 is provided with a housing 202 and a water resistant seal 204 formed in a two-shot operation. The water resistant seal 204 is formed of a material that will chemically bond to the housing 202. In a preferred embodiment, the water resistant seal 204 may be formed of a thermoplastic elastomer (TPE) and the housing 202 may be formed of polypropylene.

The housing 202 has a rearward portion 206, a middle portion 208, and a forward portion 210. The rearward portion 206 extends from a rearward surface 212 of the housing 202 to the middle portion 208. The middle portion 208 extends from the rearward portion 206 to the forward portion 210. The forward portion 210 extends from the middle portion 208 to a forward surface 214 of the housing 202. Each of the rearward, middle and forward portions 206, 208, 210 have a substantially box-shape configuration. An outer surface 216 of the housing 202 extends from the rearward surface 212 to the forward surface 214. The rearward portion 206 is smaller in configuration relative to the middle portion 208 such that an exposed rearward surface of the middle portion 208 defines a first outer shoulder 218 of the outer surface 216 of the housing 202. The middle portion 208 is smaller in configuration relative to the forward portion 210 such that an exposed rearward surface of the forward portion 210 defines a second outer shoulder 220 of the outer surface 216 of the housing 202.

Figure 11:
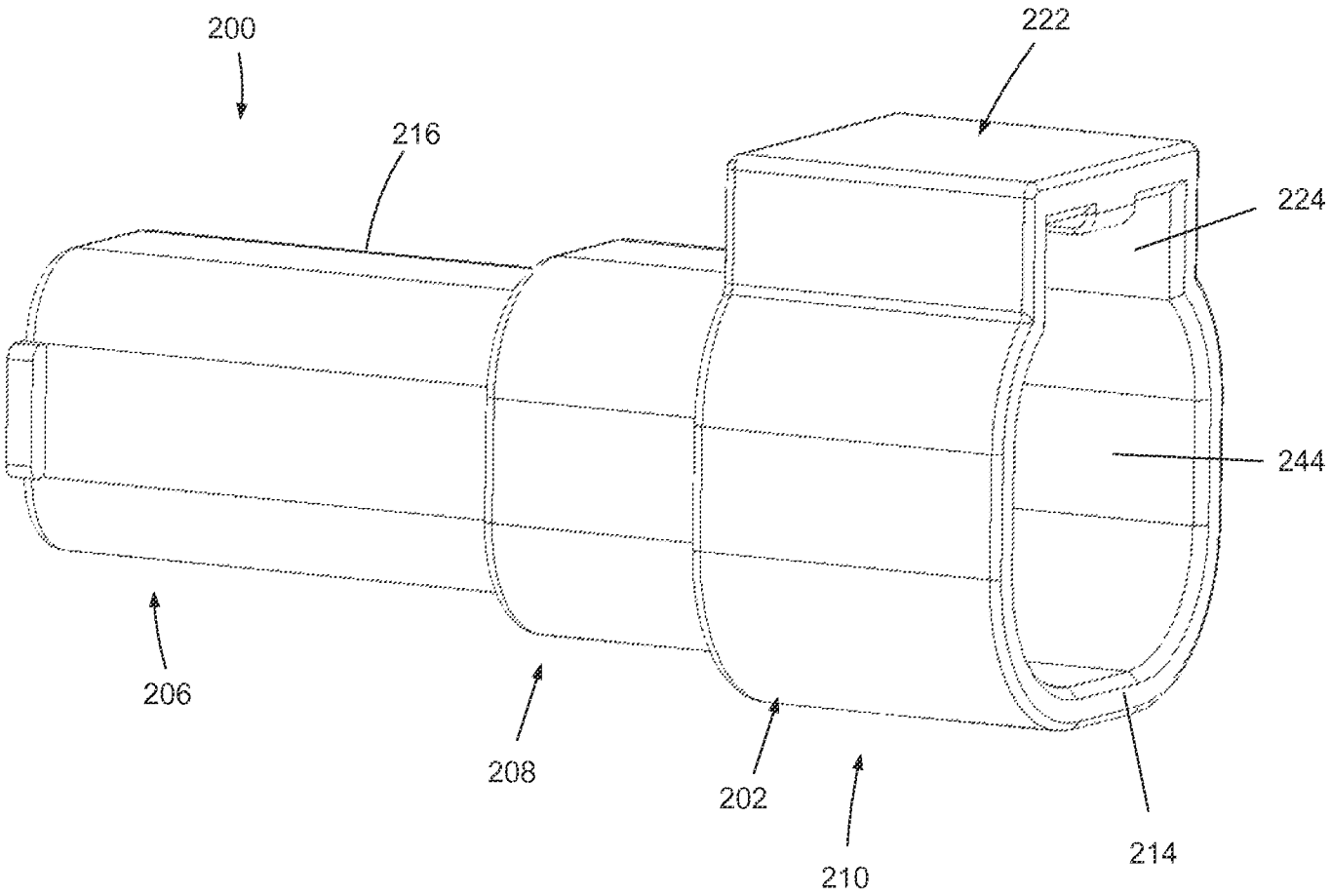
FIG. 11 illustrates a first perspective view of a second connector of the water resistant connector assembly.
Figure 12:
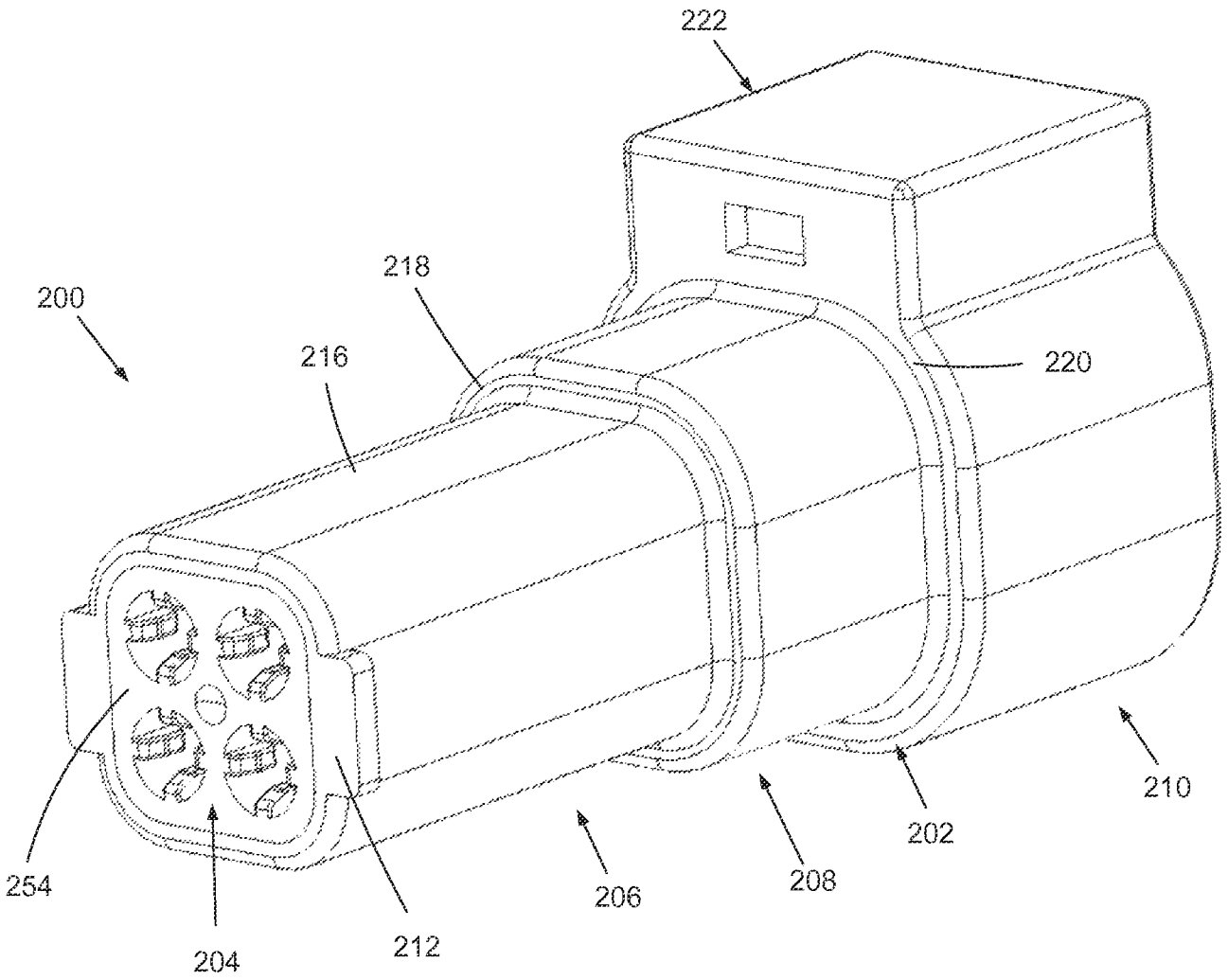
FIG. 12 illustrates a second perspective view of the second connector of the water resistant connector assembly.

The housing 202 has a lock portion 222 extending outwardly from one side of the forward portion 210 of the outer surface 216 of the housing 202. In a preferred embodiment, as illustrated in FIGS. 11 and 12, the lock portion 222 does not extend over the middle or rearward portions 208, 206 of the housing 202. The lock portion 222 forms a second part of the selectively engageable locking structure 30 of the water resistant connector assembly 20, The lock portion 222 defines a latch-receiving chamber 224.

The housing 202 defines a seal accommodation chamber 226. The seal accommodation chamber 226 extends forwardly from the rearward surface 212 of the housing 202 into the rearward portion 206 to an inner rear surface 228 of the housing 202. The seal accommodation chamber 226 defines a chamber wall 230 that extends from the rearward surface 212 of the housing 202 to the inner rear surface 228 of the housing 202. The inner rear surface 228 of the housing 202 is preferably provided in the rearward portion 206 of the housing 202.

Figure 13:
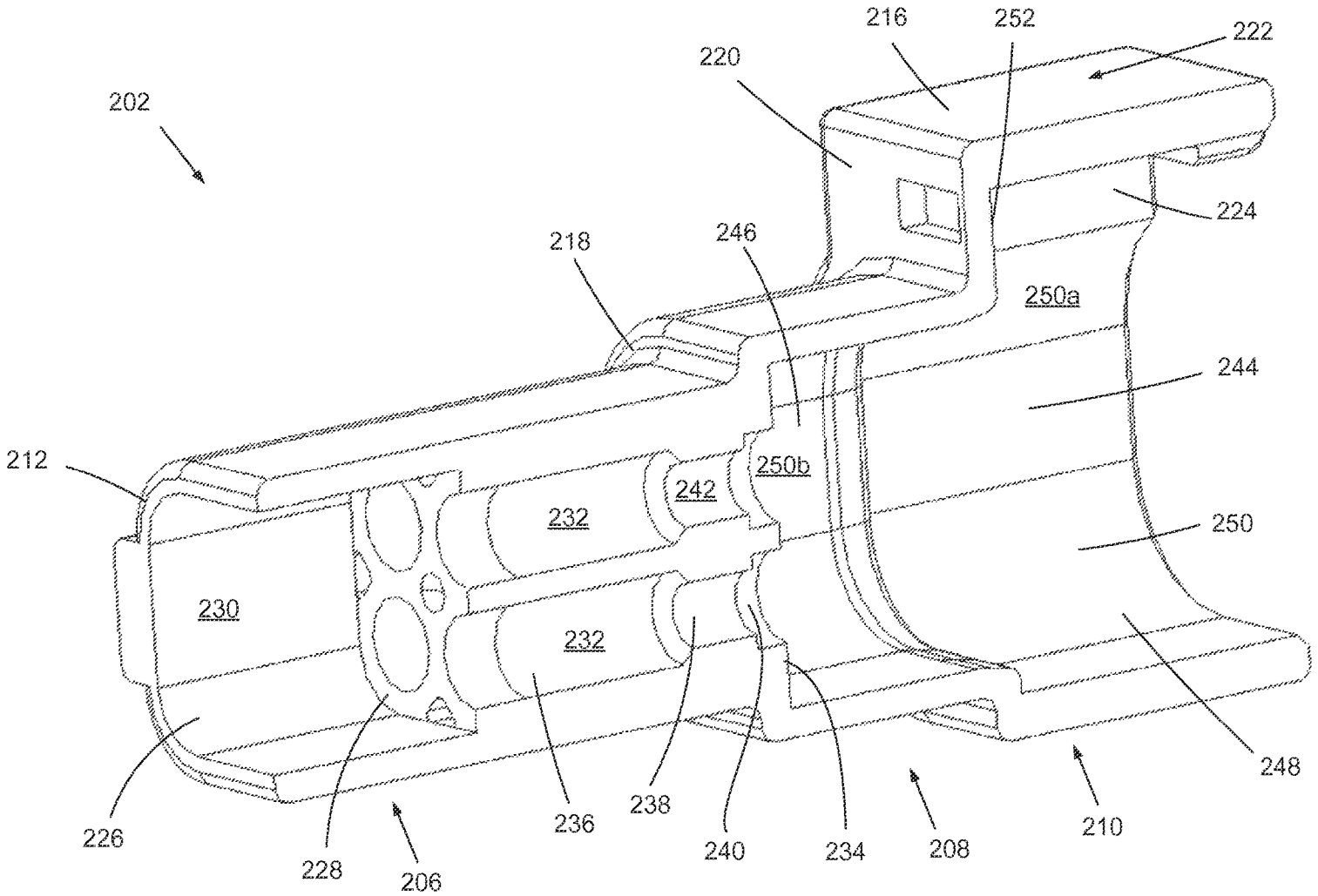
FIG. 13 illustrates a cross-sectional view of a housing of the second connector of the water resistant connector assembly.

The housing 202 defines a plurality of terminal accommodation chambers 232 which extend forwardly from the inner rear surface 228 of the housing 202 to an inner forward surface 234 of the housing 202. The plurality of terminal accommodation chambers 232, as illustrated in FIG. 13, number four (4), but it is to be understood that more or less (even one (1)) could be provided as desired. Furthermore, the plurality of terminal accommodation chambers 232, as illustrated in FIG. 13, are provided in a double row in a 2×2 configuration, but it is to be understood that the terminal accommodation chambers 232 could alternatively be provided in a single row. The number of terminal accommodation chambers 232 provided, and the configuration of the terminal accommodation chambers 232 provided, e.g., double row or single row, should match the number and configuration of terminal accommodation chambers 134 provided in the housing 102 of the first connector 100. Each of the terminal accommodation chambers 232 has a rearward portion 236, a middle portion 238, and a forward portion 240, each of which are preferably cylindrical in configuration. Each terminal accommodation chamber 232 defines a chamber wall 242 that extends from the inner rear surface 228 of the housing 202 to the inner forward surface 234 of the housing 202.

The rearward portions 236 of the terminal accommodation chambers 232 extend from the inner rear surface 228 to the corresponding middle portions 238. The middle portions 238 extend from the corresponding rearward portions 236 to the corresponding forward portions 240. The forward portions 240 extend from the corresponding middle portions 238 to the inner forward surface 234 of the housing 202. The middle portions 238 have diameters which are smaller than diameters of the rearward and forward portions 236, 238 of the housing 202.

The middle and forward portions 208, 210 of the housing 202 define a connector-receiving chamber 244. The connector-receiving chamber 244 extends rearwardly from the forward surface 214 of the housing 202, into and through the forward portion 210, and into the middle portion 208 to the inner forward surface 234 of the housing 202.

The connector-receiving chamber 244 has a rearward portion 246 and a forward portion 248. The rearward portion 246 of the connector-receiving chamber 244 is defined by the middle portion 208 of the housing 202 and the forward portion 248 of the connector-receiving chamber 244 is defined by the forward portion 210 of the housing 202. The connector-receiving chamber 244 defines a chamber wall 250 that extends from the forward surface 214 of the housing 202 to the inner forward surface 234 of the housing 202. The rearward portion 246 of the connector-receiving chamber 244 is smaller than the forward portion 248 of the connector-receiving chamber 244 such that an exposed inner forward surface of the middle portion 208 defines an inner shoulder 252 of the chamber wall 250 of the housing 202. Thus, the inner shoulder 252 separates the chamber wall 250 into a forward chamber wall **250*a* of the forward portion 210 of the housing 202 and a rearward chamber wall 250 of the middle portion 208 of the housing 202**.

A portion of the forward portion 210 of the housing 202 is removed to provide that the forward portion 248 of the connector-receiving chamber 244 and the latch-receiving chamber 224 defined by the lock portion 222 are contiguous.

Figure 14:
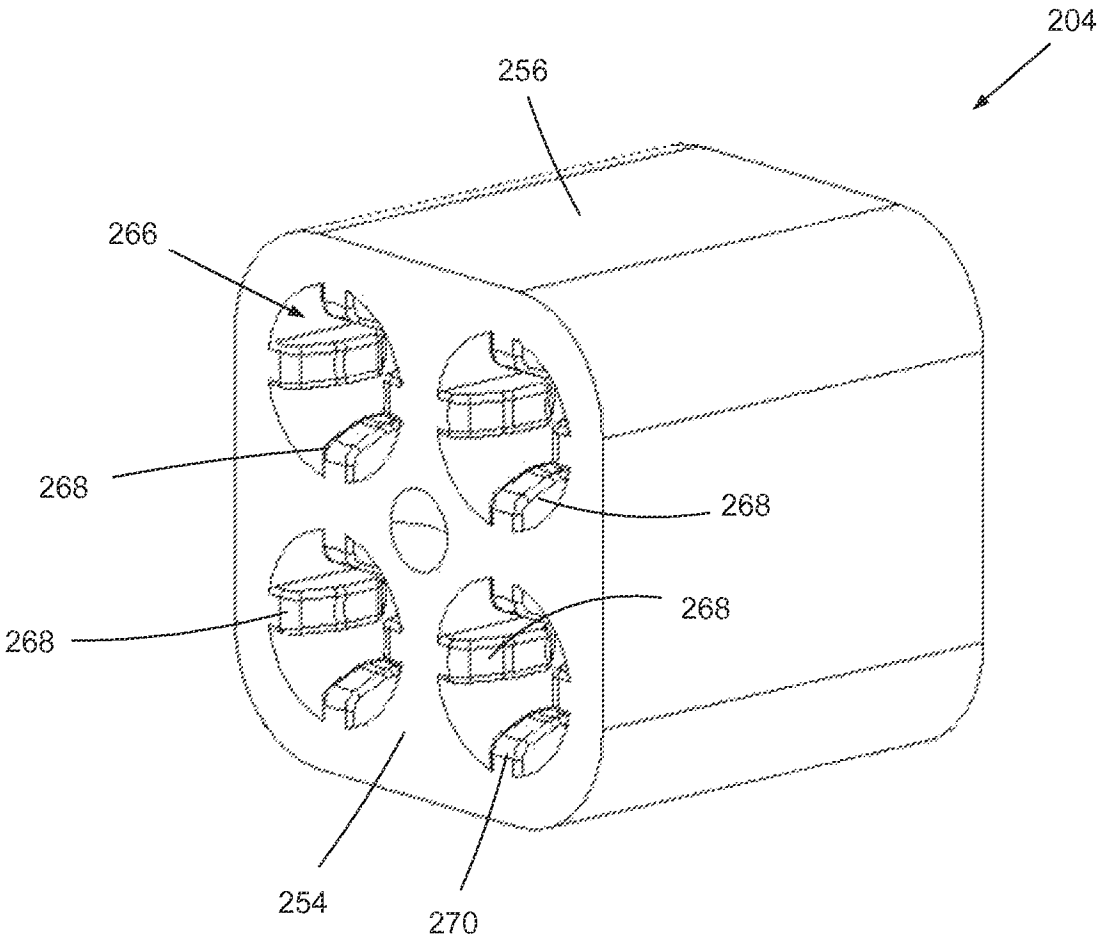
FIG. 14 illustrates a first perspective view of a water resistant seal of the second connector of the water resistant connector assembly.
Figure 15:
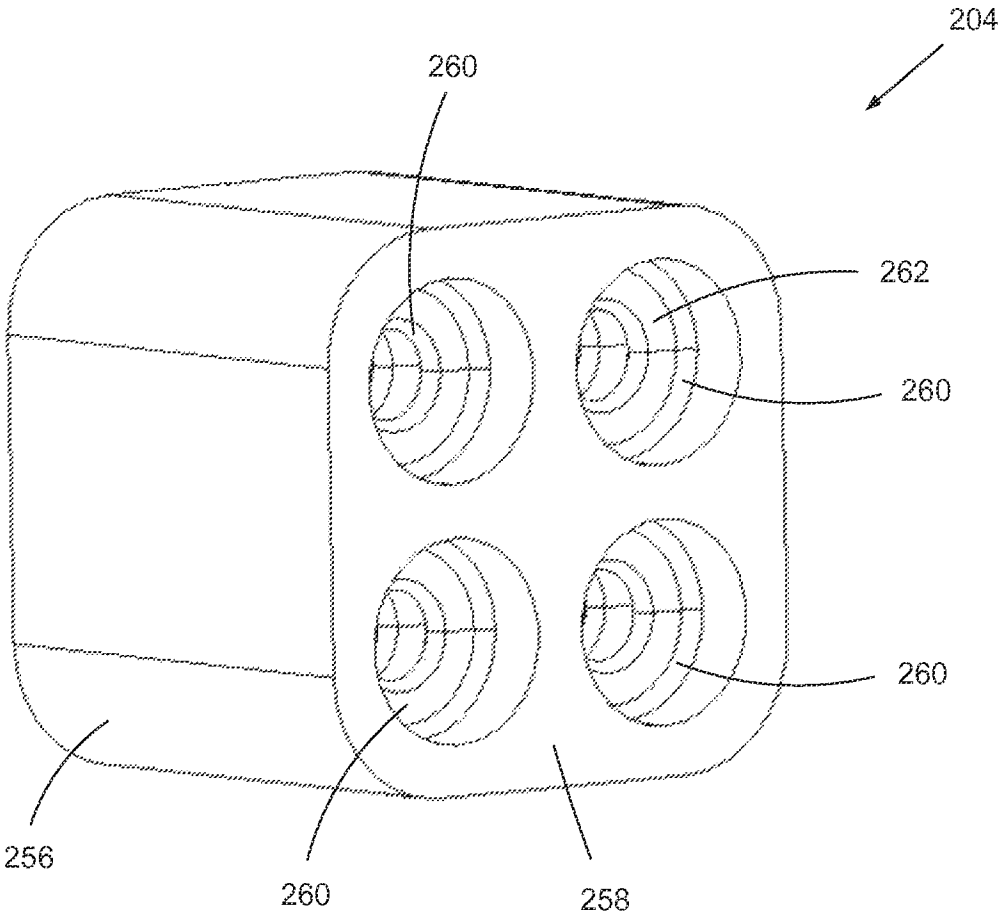
FIG. 15 illustrates a second perspective view of the water resistant seal of the second connector of the water resistant connector assembly.
Figure 16:
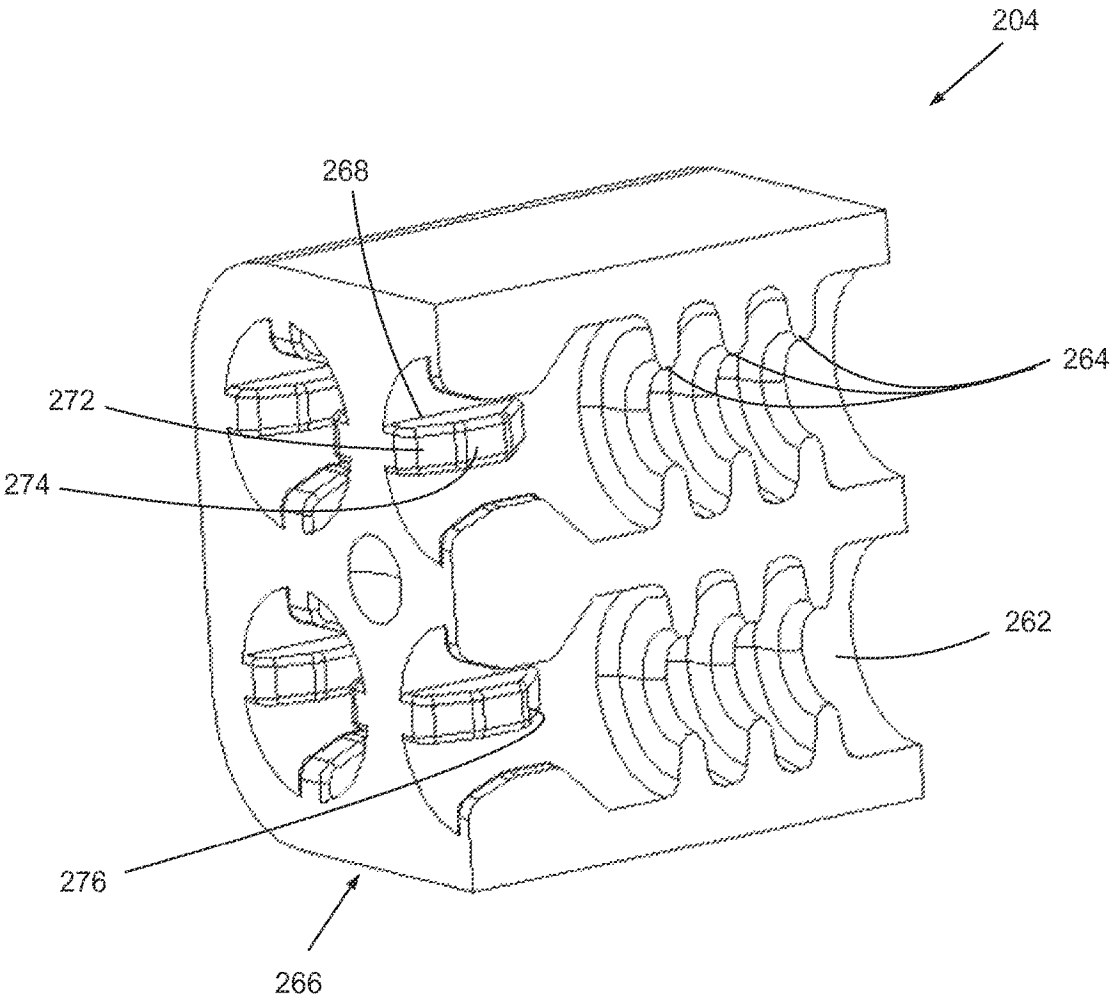
FIG. 16 illustrates a cross-sectional view of the water resistant seal of the second connector of the water resistant connector assembly.
Figure 17:
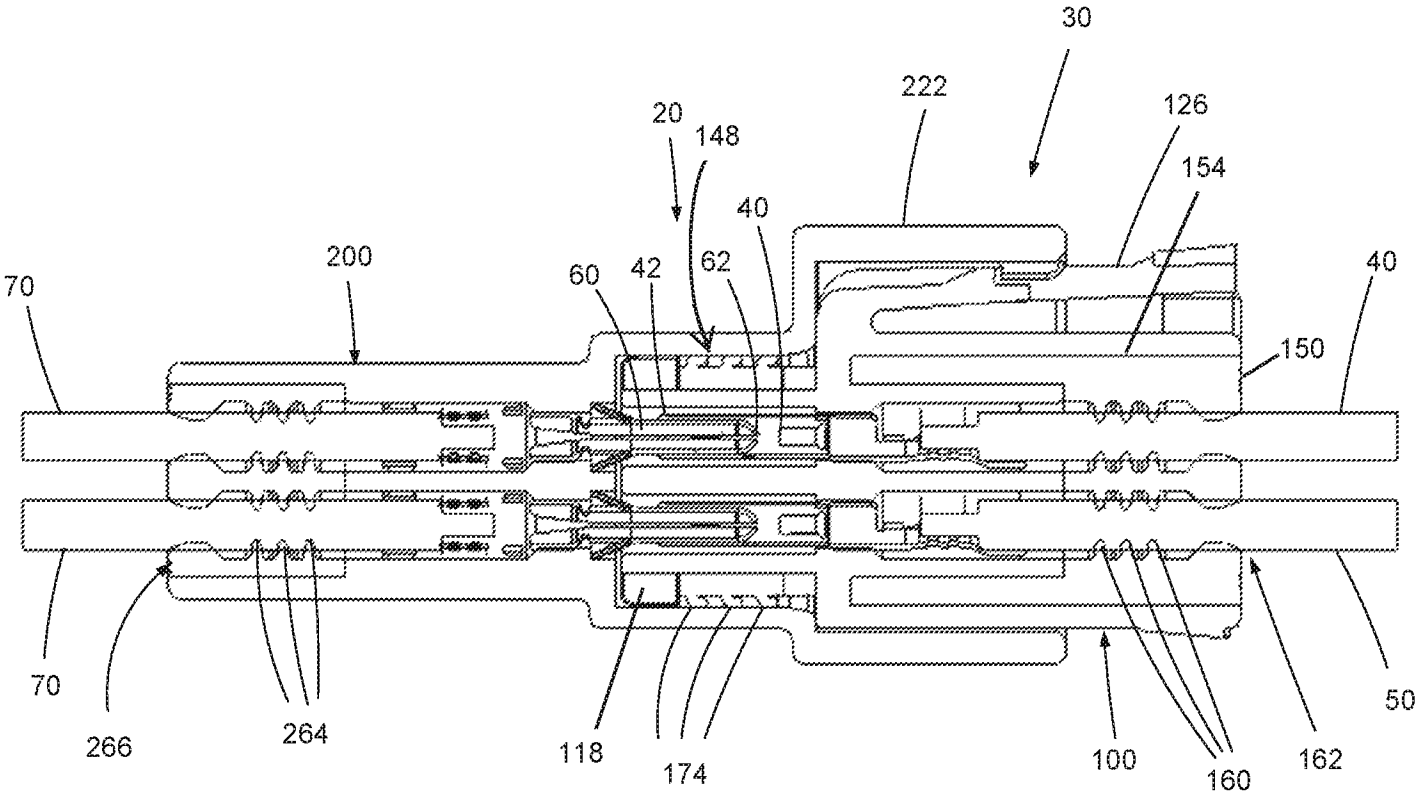
FIG. 17 illustrates a cross-sectional view of the water resistant connector assembly which shows the wires/terminals in position.
Figure 18:
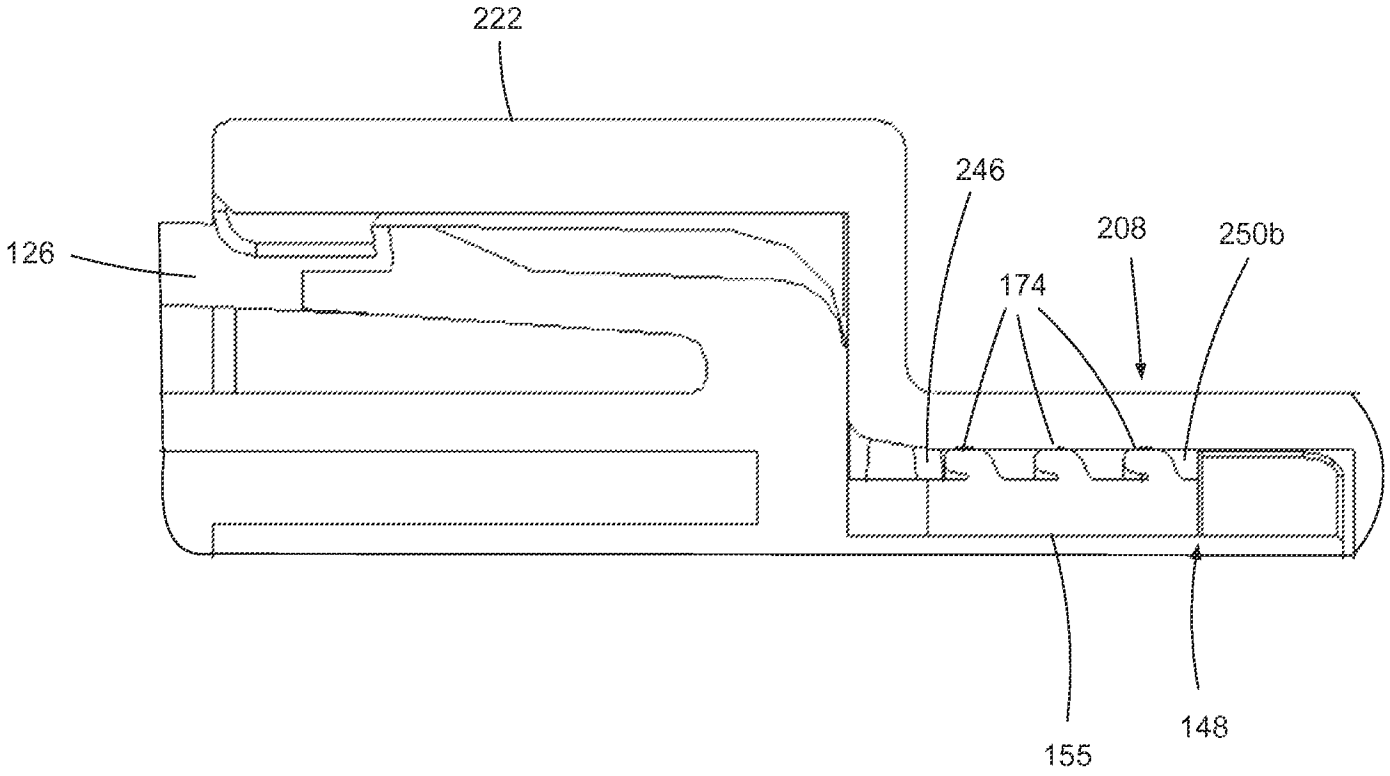
FIG. 18 illustrates an exploded cross-sectional view of a portion of the water resistant connector assembly which shows the interaction between the second connector and the water resistant seal of the first connector.

As best illustrated in FIGS. 14-16, the water resistant seal (a mat seal) 204 is configured to be positioned in and fill up the space of the seal accommodation chamber 226 of the housing 202. A rearward surface 254 of the water resistant seal 204 is (preferably flush with the rearward surface 212 of the housing 202. An outer surface 256 of the water resistant seal 204 is chemically bonded to the chamber wall 230 defined by the seal accommodation chamber 226 of the housing 202. A forward surface 258 of the water resistant seal 204 is chemically bonded to the inner rear surface 228 of the housing 202.

The water resistant seal 204 defines a plurality of through holes 260, each of which defines a wall 262, which extend forwardly from the rearward surface 254 of the water resistant seal 204 to the forward surface 258 of the water resistant seal 204. The plurality of through holes 260, as illustrated in FIGS. 14 and 15, number four (4), but it is to be understood that more or less (even one (1)) could be provided as desired. Furthermore, the plurality of through holes 260, as illustrated in FIGS. 14 and 15, are provided in a double row in a 2×2 configuration, but it is to be understood that the through holes 260 could alternatively be provided in a single row. The number of through holes 260 provided, and the configuration of the through holes 260 provided, e.g., a double row or a single row, should match the number and configuration of terminal accommodation chambers 232 provided in the housing 202. Each one of the through holes 260 is configured to be in alignment with one of the terminal accommodation chambers 232.

Each through hole 260 preferably has a diameter which is preferably equal to a diameter of the rearward portions 236 of the terminal accommodation chambers 232. Thus, the walls 262 of the through holes 260 proximate to the rearward portions 236 of the terminal accommodation chambers 232 are preferably flush with the chamber walls 242 of the rearward portions 236 of the terminal accommodation chambers 232.

The water resistant seal 204 has a plurality of ribs 264 that circumferentially extend inwardly from each of the walls 262 of the through holes 260. The plurality of ribs 264, as illustrated in FIG. 16, number three (3), but it is to be understood that more or less (even one (1)) could be provided as desired.

Between the plurality of ribs 264 and the rearward surface 254 of the water resistant seal 204, the water resistant seal 204 has a strain relief portion 266 defined in the through holes 260. The strain relief portion 266 is defined by a plurality of flanges 268 that extend inwardly from the walls 262 of the through holes 260 in a longitudinal direction. Each flange 268 is preferably provided equidistantly apart from an adjacent flange 268. As illustrated, the plurality of flanges 268 preferably number four (4) and are preferably provided ninety (90) degrees apart from an adjacent flange 268. While four (4) flanges 268 are illustrated, it is to be understood that more or less could be provided as desired.

Each flange 268 preferably has a rearward surface 270 that is flush with the rearward surface 254 of the water resistant seal 204. Each flange 268 has a first inner surface 272 that angularly extends inwardly and forwardly to a second inner surface 274. The connection between the rearward surface 270 of the flange 268 and the first inner surface 272 of the flange 268 may be rounded if desired. The second inner surface 274 extends forwardly to a third inner surface 276. The third inner surface 276 extends outwardly and forwardly to the wall 262 of the through hole 260.

The water resistant seal 204 may be provided with a forward extending portion (not shown) which extends forward from the forward surface 258 of the water resistant seal 204. The forward extending portion extends forward through a corresponding hole (not shown) provided through the rearward portion 206 of the housing 202. The corresponding hole does not interfere with, and is not open to, the terminal accommodation chambers 232 defined by the housing 202. The corresponding hole may, in whole or in part, be formed as a recessed portion provided along the outer surface 216 of the housing 202. The forward extending portion would be chemically bonded to the housing 202.

Connection of the first connector 100 to the second connector 200 to form the water resistant connector assembly 20 will now be discussed with reference to FIGS. 1-4, 17 and 18. Prior to connecting the first connector 100 to the second connector 200, wires/terminals need to be installed in the first and second connectors 100, 200, which will be discussed with reference to FIG. 17.

Rear ends of a plurality of female terminals 40 are crimped to first wires 50 in order to secure the female terminals 40 to the first wires 50 and to provide an electrical connection between the female terminals 40 and the first wires 50. Likewise, rear ends of a plurality of male terminals 60 are crimped to second wires 70 in order to secure the male terminals 60 to the second wires 70 and to provide an electrical connection between the male terminals 60 and the second wires 70. The number of female terminals 40, first wires 50, male terminals 60, and second wires 70 should match the number of terminal accommodation chambers 134, 232 provided in the first and second connectors 100, 200, respectively.

Each female terminal 40 is then inserted into and through one of the through holes 156 of the rearward portion 144 of the water resistant seal 104 provided in the first connector 100. Each female terminal 40 is then inserted into the corresponding terminal accommodation chamber 134 until a forward end 42 of the female terminal 40 is positioned in the forward portion 140 of the terminal accommodation chamber 134, but still rearward of the forward surface 112 of the first connector 100. The water resistant seal 104 being chemically bonded to the housing 102 aids in ensuring that the through holes 156 of the water resistant seal 104 remain properly positioned relative to the terminal accommodation chambers 134 of the housing 102 when the female terminal 40 is inserted through the water resistant seal 102.

The plurality of ribs 160 of the rearward portion 144 of the water resistant seal 104 are configured to be compressed and/or flexed forwardly upon the insertion of the female terminal 40. When the female terminal 40 is properly positioned in the terminal accommodation chamber 134, the plurality of ribs 160 are compressed and/or flexed against the first wire 50. The plurality of ribs 160 being compressed and/or flexed against the first wire 50 provides a water resistant seal between the first connector 100 and the first wire 50 so that water is resisted from ingressing into the terminal accommodation chamber 134 of the first connector 100 and coming into contact with the female terminal 40.

When the female terminal 40 is properly positioned in the terminal accommodation chamber 134, the plurality of flanges 164 of the strain relief portion 162 are compressed or flexed or bent against the first wire 50. The plurality of flanges 164 being compressed or flexed or bent against the first wire 50 provide resistance to angularity of the first wire 50 which, if angled, will reduce the seal compression on one side of the first wire 50.

Each male terminal 60 is then inserted into and through one of the through holes 260 of the water resistant seal 204 provided in the second connector 200. Each male terminal 60 is then inserted into the corresponding terminal accommodation chamber 232 until a forward end 62 of the male terminal 60 is positioned beyond the inner forward surface 234 of the second connector 200, The water resistant seal 204 being chemically bonded to the housing 202 aids in ensuring that the through holes 260 of the water resistant seal 204 remain properly positioned relative to the terminal accommodation chambers 232 of the housing 202 when the male terminal 60 is inserted through the water resistant seal 204.

The plurality of ribs 264 of the water resistant seal 204 are compressed and/or flexed forwardly upon the insertion of the male terminal 60. When the male terminal 60 is properly positioned in the terminal accommodation chamber 232, the plurality of ribs 264 are compressed and/or flexed against the second wire 70. The plurality of ribs 264 being compressed and/or flexed against the second wire 70 provides a water resistant seal between the second connector 200 and the second wire 70 so that water is resisted from ingressing into the terminal accommodation chamber 232 of the second connector 200 and coming into contact with the male terminal 60.

When the male terminal 60 is properly positioned in the terminal accommodation chamber 232, the plurality of flanges 268 of the strain relief portion 266 are compressed or flexed or bent against the second wire 70. The plurality of flanges 268 being compressed or flexed or bent against the second wire 70 provide resistance to angularity of the second wire 70 which, if angled, will reduce the seal compression on one side of the second wire 70.

Once the first and second connectors 100, 200 have the terminals 40, 60 and wires 50, 70, respectively, positioned and secured therein, the first and second connectors 100, 200 can be secured to one another, thereby allowing for the male and female terminals 40, 60 to engage one another to create an electrical connection between them. The connection will be described by moving the first connector 100 relative to the second connector 200, but it is to be understood that the connection may be made by moving the second connector 200 relative to the first connector 100 or by moving both the first and second connectors 100, 200 relative to one another.

The first connector 100 is first moved to position the forward portion 108 of the housing 102 and the forward portion 148 of the water resistant seal 104 into the forward portion 248 of the connector-receiving chamber 244 of the housing 202 of the second connector 200. Thereafter, the first connector 100 is moved to position the forward portion 108 of the housing 102 and the forward portion 148 of the water resistant seal 104 into the rearward portion 246 of the connector-receiving chamber 244 of the housing 202 of the second connector 200.

When the forward portion 108 of the housing 102 and the forward portion 148 of the water resistant seal 104 are properly positioned in the rearward portion 246 of the connector-receiving chamber 244 of the housing 202 of the second connector 200, the following occurs:

(1) the forward surface 112 of the first connector 100 is in facing or abutting position with the inner forward surface 234 of the second connector 200;

(2) each of the terminal accommodation chambers 134 of the first connector 100 are in proper alignment with a respective terminal accommodation chamber 232 of the second connector 200;

(3) the forward ends 62 of each male terminal 60 provided in the second connector 200 are inserted into an aligned terminal accommodation chamber 134 of the first connector 100 and each male terminal 60 is engaged with the female terminal 40 that is provided in the aligned terminal accommodation chamber 134, thereby creating an electrical connection between the female and male terminals 40, 60;

(4) the plurality of ribs 174 of the forward portion 148 of the water resistant seal 104 are to be flexed rearwardly upon engagement with the rearward portion 246 of the chamber wall 250 of the connector-receiving chamber 244. More specifically, the ribs 174 are provided in a certain size such that they are more like flaps that are designed to fold over rather than compress. The plurality of ribs 174 being flexed or folded over rearwardly against the chamber wall 250 provides a water resistant seal between the first connector 100 and the second connector 200 so that water is resisted from ingressing into either of the first and second connectors 100, 200 at their connection and coming into contact with either of the male or female terminals 60, 40. More specifically, the mating of the connectors 100, 200 causes the ribs 174 to flex/fold in a rearward direction, it makes ingress of water caused by a vacuum of a hot to cold event more difficult as the water is actually pressing the ribs 174 up against the chamber wall 250 of the second connector 200, thus creating more of a seal. Furthermore, in order for the water to ingress, the water would have to flip the ribs 174 in the opposite direction in order to breach it, which would take a high amount of force to do;

(5) a forward portion of the rearward portion 106 of the housing 102 of the first connector 100 is positioned within the forward portion 248 of the connector-receiving chamber 244 of the housing 202 of the second connector 200; and (6) the resilient latching portion 126 associated with the first connector 100 is positioned within the latch-receiving chamber 224 defined by the lock portion 222 associated with the second connector 200. The lock portion 222 thus retains and locks the resilient latching portion 126 in place, thereby fixedly securing the first connector 100 to the second connector 200.

It should be noted that modifications to the water resistant connector assembly 20 may be made as desired. For instance, one or both of the strain relief portions 162, 266 of the first and second connectors 100, 200, respectively, could be removed. In addition, while the water resistant seal 104 is described and illustrated as being formed as a single piece, such a construction is not necessary and, if desired, the forward and rearward portions 148, 144 of the water resistant seal 104 could be separate, such that the middle connecting portion 146 may not be needed, or may be modified as needed.

It should also be noted that in certain embodiments, the rearward portion 106 of the water resistant seal 104 may be omitted. For example, the housing 102 could be insert molded directly around the first wire 50. Such a connector would be limited to only the preselected wire, but for certain applications, the increased robustness of the direct mold around the wire might be an acceptable tradeoff. The forward portion 148 of the water resistant seal 104, however, would still be needed to seal against the second connector 200.

If desired, the configuration of the selectively engageable locking structure 30 could be modified such that the resilient latching portion provided a retention receiving chamber or recess, and such that the lock portion would be received within the retention receiving chamber or recess in order to be engaged with the resilient latching portion. Alternatively, if desired, the configuration of the selectively engageable locking structure 30 could be reversed, such that the resilient latching portion is associated with the second connector and the lock portion is associated with the first connector.

While the connector assembly 20 is described herein as being a water resistant connector assembly 20, it is to be understood that the connector assembly 20 may also be used to resist other fluids, gases, or foreign particles, such as dust, from entering the terminal accommodation chambers. Thus, the term "water" as used herein and in the claims is intended to be broadly interpreted to include any fluid, gas or foreign particle.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Any recitation of ranges of values herein is merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A water resistant connector comprising:

a housing which extends from a forward surface to a rearward surface, the housing defining a seal accommodation chamber which is open to the rearward surface of the housing, the housing further defining at least one terminal accommodation chamber which is in communication with the seal accommodation chamber and which extends forward toward the forward surface of the housing; and a first water resistant seal positioned in the seal accommodation chamber and chemically bonded to the housing, the first water resistant seal having a rearward surface which is generally flush with the rearward surface of the housing, the first water resistant seal having at least one through hole provided therethrough, the at least one through hole being in alignment with the at least one terminal accommodation chamber of the housing, the first water resistant seal providing at least one rib which extends into the at least one through hole, the at least one rib configured to seal against a wire inserted therethrough in order to resist an ingress of water to the at least one terminal accommodation chamber via the at least one through hole of the first water resistant seal, wherein the first water resistant seal further provides a strain relief portion, the strain relief portion being positioned between the rearward surface of the first water resistant seal and the at least one rib which extends into the at least one through hole, and wherein the strain relief portion comprises a plurality of flanges that extend into the at least one through hole, the plurality of flanges configured to be positioned against the wire to provide resistance to angularity of the wire.

2. The water resistant connector as defined in claim 1, wherein the housing and the first water resistant seal are formed as a part of a two-shot operation.

3. The water resistant connector as defined in claim 2, wherein the housing is formed of polypropylene and the first water resistant seal is formed of a thermoplastic elastomer (TPE).

4. The water resistant connector as defined in claim 1, wherein the at least one terminal accommodation chamber is configured to receive a female terminal therein.

5. The water resistant connector as defined in claim 1, wherein the at least one terminal accommodation chamber is configured to receive a male terminal therein.

6. The water resistant connector as defined in claim 1, wherein each of the flanges is provided equidistantly apart from adjacent flanges.

7. The water resistant connector as defined in claim 1, wherein each of the flanges has a rearward surface, a first inner surface, a second inner surface, and a third inner surface, the rearward surface of each flange being generally flush with the rearward surface of the first water resistant seal, the first inner surface angularly extending inwardly and forwardly to the second inner surface, the second inner surface extending forwardly to the third inner surface, the third inner surface angularly extending outwardly and forwardly to a wall defined by the at least one through hole.

8. The water resistant connector as defined in claim 1, wherein a portion of a selectively engageable locking structure is operatively associated with the housing, the selectively engageable locking structure being configured to connect the first water resistant connector to another connector.

9. The water resistant connector as defined in claim 8, wherein the portion of the selectively engageable locking structure is a resilient latching portion.

10. The water resistant connector as defined in claim 8, wherein the portion of the selectively engageable locking structure is a lock portion.

11. The water resistant connector as defined in claim 1, further comprising a second water resistant seal, the second water resistant seal being chemically bonded to an outer surface of the housing, the second water resistant seal being configured to create a water resistant seal between the water resistant connector and another connector when the other connector is connected to the water resistant connector.

12. The water resistant connector as defined in claim 11, wherein the housing, the first water resistant seal, and the second water resistant seal are formed as a part of a two-shot operation.

13. The water resistant connector as defined in claim 12, wherein the housing is formed of polypropylene and the first and second water resistant seals are formed of a thermoplastic elastomer (TPE).

14. The water resistant connector as defined in claim 11, wherein the first and second water resistant seals are each integrally formed with each other.

15. The water resistant connector as defined in claim 11, wherein the second water resistant seal has at least one rib extending outwardly therefrom, the at least one rib configured to fold over in a direction opposite a water ingression direction when the other connector is connected to the water resistant connector, wherein the folding over of the at least one rib against the other connector resists an ingress of water to the at least one terminal accommodation chamber via the connection of the water resistant connector to the other connector.

16. A water resistant connector assembly comprising:

a first connector having a first housing and a first water resistant seal, the first housing having a forward surface and a rearward surface, the first housing having at least one terminal accommodation chamber for housing a first terminal, the first water resistant seal chemically bonded to an outer surface of the first housing proximate to the forward surface thereof, the first water resistant seal having at least one rib extending outwardly therefrom; and a second connector having a second housing, the second housing having a forward surface and a rearward surface, the second housing having at least one terminal accommodation chamber for housing a second terminal, the second terminal configured to be electrically connected to the first terminal;

wherein the at least one rib is configured to fold over in a direction opposite a water ingression direction when the second connector is connected to the first connector, wherein the folding over of the at least one rib against the second connector resists an ingress of water to the at least one terminal accommodation chambers of the first and second housings via the connection of the first connector to the second connector, wherein the first and second housings each define a seal accommodation chamber which is open to the rearward surfaces of the first and second housings, respectively, and which extends forwardly to the at least one terminal accommodation chambers of the first and second housings, respectively, the seal accommodation chambers being in communication with the at least one terminal accommodation chambers of the first and second housings, respectively, and wherein each of the first and second connectors further include a second water resistant seal positioned in the seal accommodation chambers and chemically bonded to the first and second housings, respectively, and wherein the second water resistant seal of the first connector is integrally formed with the first water resistant seal of the first connector.

17. The water resistant connector assembly as defined in claim 16, wherein each second water resistant seal has a rearward surface which is generally flush with the rearward surface of the first and second housing, respectively, each second water resistant seal having at least one through hole provided therethrough, the at least one through hole being in alignment with the at least one terminal accommodation chambers of the first and second housings, respectively, each second water resistant seal providing at least one rib which extends into the at least one through hole, the at least one rib configured to seal against a wire inserted therethrough in order to resist an ingress of water to the at least one terminal accommodation chambers of the first and second housings, respectively, via the at least one through hole of the second water resistant seal.

18. The water resistant connector assembly as defined in claim 17, wherein each second water resistant seal further provides a strain relief portion, the strain relief portion being positioned between the rearward surface of the second water resistant seal and the at least one rib which extends into the at least one through hole.

19. The water resistant connector assembly as defined in claim 16, further comprising a selectively engageable locking structure configured to connect the first connector to the second connector, the first water resistant seal configured to create a water resistant seal between the first connector and the second connector when the selectively engageable locking structure connects the first and second connectors to one another.

20. A water resistant connector comprising:

a housing which extends from a forward surface to a rearward surface, the housing defining a seal accommodation chamber which is open to the rearward surface of the housing, the housing further defining at least one terminal accommodation chamber which is in communication with the seal accommodation chamber and which extends forward toward the forward surface of the housing;

a first water resistant seal positioned in the seal accommodation chamber and chemically bonded to the housing, the first water resistant seal having a rearward surface which is generally flush with the rearward surface of the housing, the first water resistant seal having at least one through hole provided therethrough, the at least one through hole being in alignment with the at least one terminal accommodation chamber of the housing, the first water resistant seal providing at least one rib which extends into the at least one through hole, the at least one rib configured to seal against a wire inserted therethrough in order to resist an ingress of water to the at least one terminal accommodation chamber via the at least one through hole of the first water resistant seal; and a second water resistant seal, the second water resistant seal being chemically bonded to an outer surface of the housing, the second water resistant seal being configured to create a water resistant seal between the water resistant connector and another connector when the other connector is connected to the water resistant connector, wherein the first and second water resistant seals are each integrally formed with each other.

21. The water resistant connector as defined in claim 20, wherein the housing and the first water resistant seal are formed as a part of a two-shot operation.

22. The water resistant connector as defined in claim 21, wherein the housing is formed of polypropylene and the first water resistant seal is formed of a thermoplastic elastomer (TPE).

23. The water resistant connector as defined in claim 20, wherein the at least one terminal accommodation chamber is configured to receive a female terminal therein.

24. The water resistant connector as defined in claim 20, wherein the at least one terminal accommodation chamber is configured to receive a male terminal therein.

25. The water resistant connector as defined in claim 20, wherein the first water resistant seal further provides a strain relief portion, the strain relief portion being positioned between the rearward surface of the first water resistant seal and the at least one rib which extends into the at least one through hole.

26. The water resistant connector as defined in claim 20, wherein a portion of a selectively engageable locking structure is operatively associated with the housing, the selectively engageable locking structure being configured to connect the first water resistant connector to another connector.

27. The water resistant connector as defined in claim 26, wherein the portion of the selectively engageable locking structure is a resilient latching portion.

28. The water resistant connector as defined in claim 26, wherein the portion of the selectively engageable locking structure is a lock portion.

29. The water resistant connector as defined in claim 20, further comprising a second water resistant seal, the second water resistant seal being chemically bonded to an outer surface of the housing, the second water resistant seal being configured to create a water resistant seal between the water resistant connector and another connector when the other connector is connected to the water resistant connector.

30. The water resistant connector as defined in claim 29, wherein the housing, the first water resistant seal, and the second water resistant seal are formed as a part of a two-shot operation.

31. The water resistant connector as defined in claim 30, wherein the housing is formed of polypropylene and the first and second water resistant seals are formed of a thermoplastic elastomer (TPE).

32. The water resistant connector as defined in claim 29, wherein the second water resistant seal has at least one rib extending outwardly therefrom, the at least one rib configured to fold over in a direction opposite a water ingression direction when the other connector is connected to the water resistant connector, wherein the folding over of the at least one rib against the other connector resists an ingress of water to the at least one terminal accommodation chamber via the connection of the water resistant connector to the other connector.

33. A water resistant connector assembly comprising:

a first connector having a first housing and a first water resistant seal, the housing extends from a forward surface to a rearward surface, the housing defines a seal accommodation chamber which is open to the rearward surface of the housing, the housing further defines at least one terminal accommodation chamber which is in communication with the seal accommodation chamber and which extends forward toward the forward surface of the housing, the first water resistant seal being positioned in the seal accommodation chamber and chemically bonded to the housing, the first water resistant seal having a rearward surface which is generally flush with the rearward surface of the housing, the first water resistant seal having at least one through hole provided therethrough, the at least one through hole being in alignment with the at least one terminal accommodation chamber of the housing, the first water resistant seal providing at least one rib which extends into the at least one through hole, the at least one rib configured to seal against a wire inserted therethrough in order to resist an ingress of water to the at least one terminal accommodation chamber via the at least one through hole of the first water resistant seal; and a second connector having a second housing, the second housing configured to be connected to the first housing, wherein the first water resistant seal further provides a strain relief portion, the strain relief portion being positioned between the rearward surface of the first water resistant seal and the at least one rib which extends into the at least one through hole, and wherein the strain relief portion comprises a plurality of flanges that extend into the at least one through hole, the plurality of flanges configured to be positioned against the wire to provide resistance to angularity of the wire.

* * * * *